US008918008B2

(12) United States Patent
Okamoto et al.

(10) Patent No.: US 8,918,008 B2
(45) Date of Patent: Dec. 23, 2014

(54) CONNECTOR, CHARGING DEVICE INCORPORATING SAME, AND IMAGE FORMING APPARATUS INCORPORATING THE CONNECTOR

(75) Inventors: Keiji Okamoto, Kanagawa (JP); Kazuhiko Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 320 days.

(21) Appl. No.: 13/364,498

(22) Filed: Feb. 2, 2012

(65) Prior Publication Data

US 2012/0207507 A1 Aug. 16, 2012

(30) Foreign Application Priority Data

Feb. 10, 2011 (JP) ..... 2011-026795
Oct. 14, 2011 (JP) ..... 2011-226641

(51) Int. Cl.

| | |
|---|---|
| ***G03G 15/00*** | (2006.01) |
| ***G03G 21/18*** | (2006.01) |
| ***H01R 39/64*** | (2006.01) |
| ***G03G 21/16*** | (2006.01) |
| *H01R 39/12* | (2006.01) |

(52) U.S. Cl.

CPC ..... *H01R 39/64* (2013.01); *G03G 21/1871* (2013.01); *G03G 21/1652* (2013.01); *H01R 39/12* (2013.01)

USPC ..... 399/90

(58) Field of Classification Search

CPC ..... G03G 21/1652; G03G 2221/166

USPC ..... 399/89, 90

See application file for complete search history.

(56) References Cited

U.S. PATENT DOCUMENTS

| | | | |
|---|---|---|---|
| 5,055,878 | A | 10/1991 | Okamoto et al. |
| 6,064,841 | A | 5/2000 | Matsuzaki et al. |
| 2005/0281594 | A1 | 12/2005 | Kuma et al. |

FOREIGN PATENT DOCUMENTS

| | | | | |
|---|---|---|---|---|
| CN | 1193132 | | | 9/1998 |
| CN | 2567832 | | | 8/2003 |
| CN | 1722013 | | | 1/2006 |
| JP | 60261996 | A | * | 12/1985 |
| JP | 04-320281 | A | | 11/1992 |
| JP | 06-083162 | A | | 3/1994 |
| JP | 07-219308 | A | | 8/1995 |
| JP | 2002162811 | A | * | 6/2002 |
| JP | 2007078068 | A | * | 3/2007 |
| JP | 2008-281841 | A | | 11/2008 |
| JP | 2009-109854 | A | | 5/2009 |

* cited by examiner

*Primary Examiner* — Walter L Lindsay, Jr.
*Assistant Examiner* — Milton Gonzalez
(74) *Attorney, Agent, or Firm* — Harness, Dickey & Pierce, P.L.C.

(57) ABSTRACT

A connector to electrically connect a rotary body having a shaft, the connector includes a connecting terminal, electrically connected to either a power supply or ground, to contact the shaft of the rotary body either at least two points or along a line; and a posture adjuster to hold the connecting terminal to adjust the posture of one of the connecting terminal and the rotary body to maintain contact between the connecting terminal and the shaft of the rotary body.

13 Claims, 15 Drawing Sheets

CONNECTOR, CHARGING DEVICE INCORPORATING SAME, AND IMAGE FORMING APPARATUS INCORPORATING THE CONNECTOR

CROSS-REFERENCE TO RELATED APPLICATIONS

This patent application is based on and claims priority pursuant to 35 U.S.C. §119 to Japanese Patent Application Nos. 2011-026795, filed on Feb. 10, 2011 and 2011-226641, filed on Oct. 14, 2011 in the Japan Patent Office, the entire disclosures of which are hereby incorporated by reference herein.

BACKGROUND

1. Technical Field

The present disclosure relates to a connector to electrically connect a rotary body, a charging device incorporating the connector, and an image forming apparatus incorporating the connector.

2. Description of the Related Art

Typically, rollers or other such rotary bodies to which a voltage is applied, such as a charging roller, a development roller, and a transfer roller, are used in electrophotographic image forming apparatuses. As a known connector, the roller is electrically connected to a power supply via a shaft bearing. The bearing is made electrically conductive by dispersing electrically conductive material, such as carbon fiber, in plastic. Alternatively, the roller is connected to the power supply through the roller shaft at a single point.

FIG. 29A is a diagram illustrating a contact state in which a roller shaft 6*a* of a rotary body contacts a bearing 110*x* and FIG. 29B is a diagram illustrating a state in which a foreign substance is caught in a contact portion between the shaft 6*a* and the bearing 110*x* illustrated in FIG. 29A. As illustrated in FIG. 29A, in order to rotate the rotary body smoothly, a penetration hole 110*a* of the bearing 110*x* has an internal diameter that is greater than an external diameter of the shaft 6*a*. Therefore, the shaft 6*a* of the roller contacts the bottom of the bearing 110*x*. If a foreign substance X, such as trash, is caught in a contact portion between the bearing 110*x* and the shaft 6*a* along face (in face contact situation), as illustrated in FIG. 29B, the shaft 6*a* may be separated from the bearing 110*x*, which may cause a loss of power to the shaft 6*a* and the bearing. In the alternative connector in which an electrode contacts one end of the shaft of the rotary body at a single point, if the foreign object is caught in a contact portion between the shaft 6*a* and the electrode, electrical conductivity becomes lost, which may cause to be electrical conductive failure.

In proposed image forming apparatus JP-H07-219308-A, a charging device includes a first connector constituted by an electrode to contact a charging roller at a single point to supply a voltage (charging bias) and a second connector constituted by a bearing to contact the charging roller to contacts along a line to supply a voltage. FIG. 30 is a schematic diagram illustrating a configuration of the conventional charging device in the image forming apparatus in the present example. As illustrated in FIG. 30, an electrode 105 contacts a shaft end 6*b* of the shaft 6*a* of a charging roller 6 at a single point. A wire connected to the power supply 106 to apply the charging bias to the charging roller 6 bifurcates at an intermediate portion and one branch wire (first wire) 104*a* is connected to the electrode 105, and the other branch wire (second wire) 104*b* is connected to the electrically conductive bearing 110*x*. Therefore, the charging bias in a power supply 106 is applied to the charging roller 6 via a first power supply route including the electrode 105 and a second power supply route including bearing 110*x*. In this configuration, for example, if the foreign substance is caught between the shaft end 6*b* of the charging roller 6 and the electrode 105 and electrically-conducting failure occurs in the first power supply route, an electrically conductive state between the charging roller 6 and the power supply 106 can be kept so long as an electrically conductive state between the bearing 110*x* and the shaft 6*a* is kept. Accordingly, the present configuration can eliminate this type of power failure better than a configuration in which a single power supply route is provided.

However, in the above-described configuration, it is required to provide the first wire 104*a* to connect the electrode 105 and the second wire 104*b* to connect the bearing 110*x*, which requires more wiring space than a configuration in which only a single supply route is provided. In addition, it is necessary for the bearing 110*x* to be electrically conductive, which increases manufacturing cost.

SUMMARY

In one aspect of this disclosure, there is provided a connector to electrically connect a rotary body having a shaft. The connector includes a connecting terminal that is electrically connected to either a power supply or ground contacts the shaft of the rotary body either at least two points or along a line; and a posture adjuster to hold the connecting terminal to adjust posture of one of the connecting terminal and the rotary body to maintain contact between the connecting terminal and the shaft of the rotary body.

In another aspect of this disclosure, there is provided a charging device includes a charging roller, a power supply, and a connector. The charging roller has a shaft. The power supply is operatively connected to the charging roller to apply a predetermined voltage to the charging roller. The connector electrically connects the power supply with the charging roller to supply the predetermined voltage to the charging roller. The connector includes a connecting terminal to contact one end of the shaft of the charging roller either at least two points or along a line; and a posture adjuster to holds the connecting terminal to adjust posture of one of the connecting terminal and the charging roller to maintain contact between the connecting terminal and the shaft of the charging roller.

In another aspect of this disclosure, there is provided an image forming apparatus includes an image carrier to carry a latent image; a power supply to generate a voltage; a rotary body, to which the voltage is applied, having a shaft; and the connector to electrically connect the power supply with the rotary body to supply the voltage to the rotary body. The connector includes a connecting terminal to contact the shaft of the rotary body either at least two points or along a line; and the posture adjuster that holds the connecting terminal to adjust the posture of one of the connecting terminal and the rotary body to maintain contact between the connecting terminal and the shaft of the rotary body.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
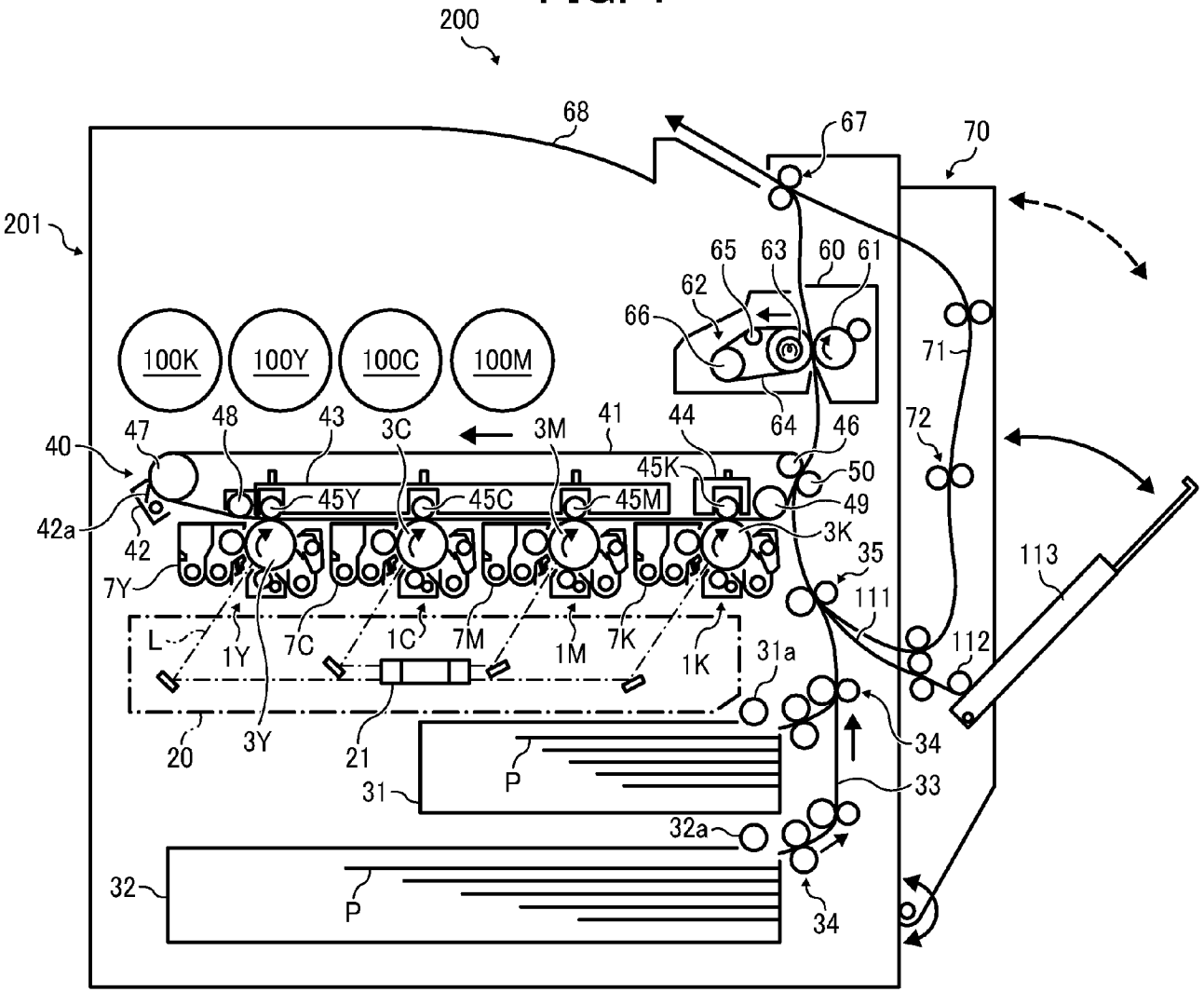
FIG. 1 is a schematic diagram illustrating an image forming apparatus according to the embodiments in the present disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result. Referring now to the drawings, wherein like reference numerals designate identical or corresponding parts throughout the several views thereof, and particularly to FIGS. 1 through 28B, an electrophotographic image forming apparatus according to illustrative embodiments of the present disclosure is described.

Initially, a configuration and operation of an image forming apparatus 200 according to embodiments in the present disclosure is described below with reference to FIGS. 1 and 2. FIG. 1 is a schematic diagram illustrating the image forming apparatus 200. As shown in FIG. 1, the image forming apparatus 200 includes four process units (process cartridges) 1Y, 1C, 1M, and 1K for forming yellow, magenta, cyan, and black toner images, respectively. Each of the process units 1Y, 1C, 1M, and 1K are removably installed in a main apparatus body 201 of the image forming apparatus 200. Each of the process units 1Y, 1C, 1M, and 1K has the same basic configuration, differing only in the color of toner used therein as an image forming material. Using the process unit 1Y purely as an example, the configuration of the process units 1Y, 1C, 1M, and 1K is described in further detail below.

Figure 2:
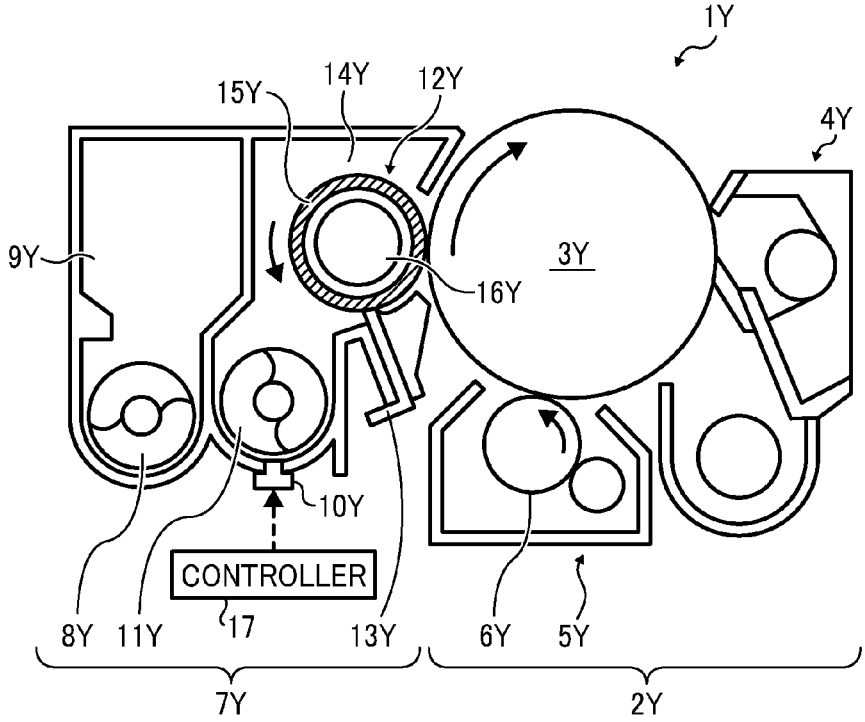
FIG. 2 is an expanded diagram illustrating a process unit for yellow provided in the image forming apparatus shown in FIG. 1.
Figure 3:
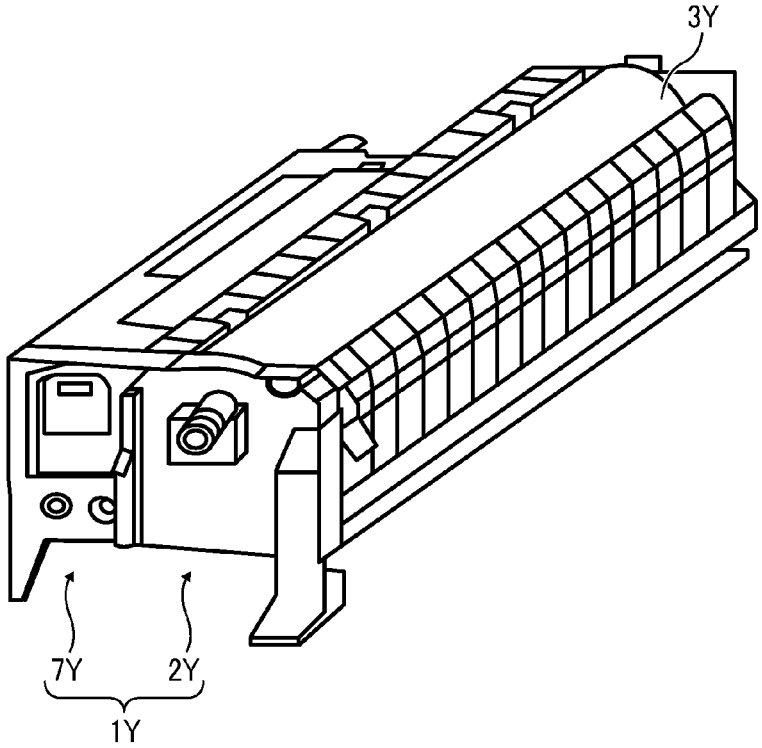
FIG. 3 is a perspective view illustrating the process unit shown in FIG. 2.
Figure 4:
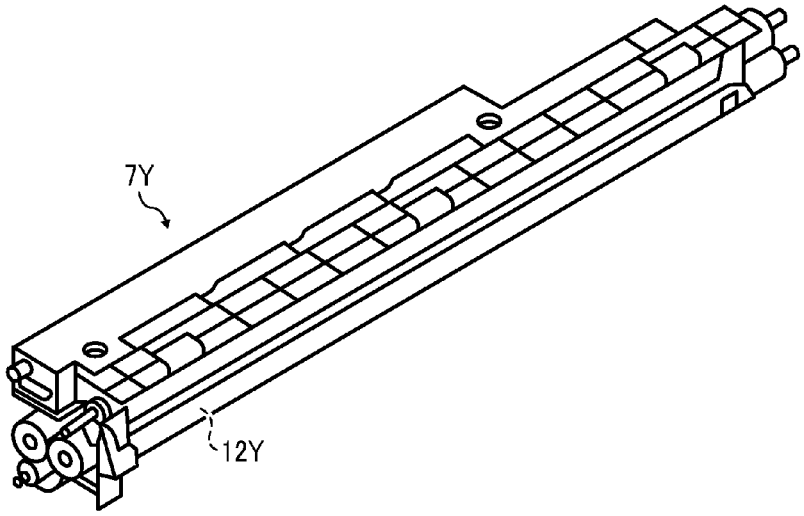
FIG. 4 is a perspective view illustrating a development unit in the process unit shown in FIG. 2.

FIG. 2 is an expanded diagram illustrating a process unit 1Y for yellow provided in the image forming apparatus 200. Referring to FIG. 2, the process unit 1Y for yellow includes a photoreceptor unit 2Y and a development unit 7Y. FIG. 3 is a perspective view illustrating the process unit 1Y. The photoreceptor unit 2Y is removably installable together with the development unit 7Y to the apparatus body 201 in the image forming apparatus 200 as the integrated process unit 1Y, as illustrated in FIG. 3. However, in a state in which the process unit 1Y is removed from the apparatus body 201, as illustrated in FIG. 4, the development unit 7Y, serving as a development device, can be removably attachable to the photoreceptor unit 2Y.

Referring back to FIG. 2, the photoreceptor unit 2Y includes a drum-shaped photoreceptor 3Y, a drum-cleaning device 4Y, a charging device 5Y, and a discharging device (not shown). The charging device 5Y includes a charging roller 6Y.

Figure 5:
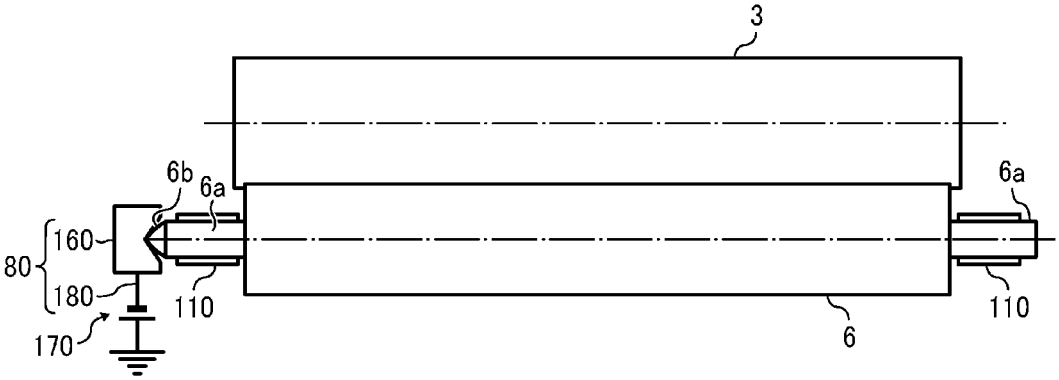
FIG. 5 is a diagram illustrating a photoreceptor, a charging roller, a connector, and a power supply in the process unit shown in FIG. 2.

The charging device 5Y uniformly charges the photoreceptor 3Y rotated in counterclockwise direction shown in FIG. 2 by a driving unit while a charging bias is being applied from a power supply 170 shown in FIG. 5. Since the charging roller 6Y that is rotated in a counterclockwise direction in FIG. 2 is positioned adjacent to the photoreceptor 3Y, the charging roller 5Y uniformly charges the photoreceptor 3Y. A charging brush (rotatable cylindrical brush) may be used as the charging member instead of the charging roller 6Y. Alternatively, a corona discharge device, such as scorotron charger, may also uniformly charge the photoreceptor 3Y using charger method instead of the charging roller 6Y. Subsequently, a surface of the photoreceptor 3Y uniformly charged by the charging roller 6Y is exposed by scanning light emitted from an optical writing unit 20, and then the surface of the photoreceptor 3Y bears latent image for yellow.

As illustrated in FIG. 2, the development unit 7Y, serving as a development device, includes a first container 9Y and a second container 14Y. A first screw conveyor 8Y is provided in the first container 9Y. A toner concentration sensor 10Y constituted by a magnetic permeability sensor, a second screw conveyor 11Y, a development roller 12Y, a doctor blade 13Y are provided in the second container 14Y. The containers 9Y and 14Y contain yellow developer constituted by magnetic carrier and negative charged yellow toner. By rotating the first screw conveyor 8Y by a driving member, the developer in the first container 9Y is conveyed from front side to back side of paper on which FIG. 2 is drawn. The developer contained in the first container 9Y is entered into the second container 14Y via a backside communication opening provided in a partition between the first container 9Y and the second container 14Y.

By rotating the second screw conveyor 11Y by a driving member, the developer in the second container 14Y is conveyed from backside to front side of paper on which FIG. 2 is drawn. The toner concentration of the Y developer during conveyance is detected by the toner concentration sensor 10Y fixed on a bottom of the second container 14Y. The development roller 12Y is provided above the second screw conveyor 11Y such that the development roller 12Y is positioned in parallel to the second screw conveyor 11Y. The development roller 12Y includes a magnet roller 16Y and a developing sleeve 15Y that is constituted by a non-magnetic pipe (hollow cylinder) and is rotated in a counterclockwise direction shown in FIG. 2. The developer conveyed by the second screw conveyor 11Y in the second container 14Y is partially pumped up to the developing sleeve 15Y due to magnetic force exerted by the magnet roller 16Y therein. Then, the developer is restricted by the developer regulator 13Y provided at a position away a predetermined distance from the developing sleeve 15Y to adjust thickness of the developer borne on the surface of the developing sleeve 15Y. Subsequently, the developer on the surface of the developing sleeve 15Y is conveyed to a developing portion facing the photoreceptor 3Y, where the Y toner is attracted to the latent image formed on the photoreceptor 3Y. With this adhesion, Y toner image is formed on the photoreceptor 3Y. The Y developer whose Y toner is consumed in developing process is returned to the second screw conveyor 11Y in the second container 14Y with rotation of the developing sleeve 15Y in the development roller 12Y. Then, when the developer is conveyed to the front end of paper FIG. 2 is drawn in the second container 14Y, the developer is returned to the first container 9Y via a front side communication opening formed in the partition between the first container 9Y and the second container 14Y.

As controlling the toner concentration, a detection result of the magnetic permeability of the Y developer detected by the toner concentration sensor 10Y is sent to a controller 17 as a voltage signal. The magnetic permeability of the Y developer is revealed correlative to the Y toner concentration of the Y developer, the toner concentration sensor 10Y outputs the voltage in accordance with the toner concentration. The controller 17 includes a random access memory (RAM). The RAM stores data as a target value Vtref-Y for an output voltage from the toner concentration sensor 10Y, and respective target values Vtref-C, Vtref-M, and Vtref-K of target voltages for output voltages from the toner concentration sensors 10C, 10M, and 10K. For yellow, the controller 17 compares an output value from the toner concentration sensor 10Y and the target value Vtref-Y, and drives a toner supply device (not shown) for a time period determined by a comparison result. By driving the toner supply device, an appropriate amount of the Y toner is supplied to the first container 9Y containing the Y developer whose toner concentration is decreased by consumption during the developing process in the second container 14Y. Thus, the Y toner concentration of the Y developer in the second container 14Y is kept at a predetermined range. Similar toner supply control is performed in other colors of the developer contained in the respective process units 1C, 1M, and 1K.

Referring back to FIG. 1, the toner image formed on the photoreceptor 3Y is transferred onto an intermediate transfer belt 41 (primary-transfer process). The drum-cleaning device 4Y in the photoreceptor unit 2Y removes un-transferred toner that remains on the surface of the photoreceptor 3Y. After that, the discharging device discharges the cleaned surface of the photoreceptor 3Y. With this discharging, the surface of the photoreceptor is initialized, which is prepared for the subsequent image forming process. In such image formation process, in other process units 1C, 1M, and 1K shown in FIG. 1, the C, M, and K toner images are formed on the photoreceptors 3C, 3M, and 3K and then are transferred onto the intermediate transfer belt 41.

The optical writing unit 20 is provided beneath the process units 1Y, 1C, 1M, and 1K shown in FIG. 1. The optical writing unit 20 irradiates the surfaces of the photoreceptors 3Y, 3C, 3M, and 3K in the process units 1Y, 1C, 1M, and 1K with a laser light L in accordance with image data. Thus, the latent images for yellow, cyan, magenta, and black are formed on the respective photoreceptors 3Y, 3C, 3M, and 3K. More specifically, in the optical writing unit 20, while the laser light L emitted from a light source (laser) therein is deflected by a polygon mirror 21 rotated by a driving motor, the laser light L is irradiated to the photoreceptors 3Y, 3C, 3M, and 3K via multiple optical lenses and minors. As an alternative configuration, optical scanning (writing) is performed by using LED (light emitting diode) array instead of the laser.

Referring to FIG. 1, a first sheet cassette 31 and a second sheet cassette 32 are provided beneath the optical writing unit 20 so that the first sheet cassette 31 is overlapped with the second sheet cassette 32 in a vertical direction. The respective sheet cassettes 31 and 32 contain multiple sheets (recording paper) P piled one on another. A first feed roller 31*a* and a second feed roller 32*a* contact the respective top of the recording papers P. When the first feed roller 31*a* is rotated counterclockwise in FIG. 1 by a driving device, the recording paper P on the top is picked up and transported from the first sheet cassette 31 to a feeding path 33 provided in right side of the first sheet cassette 31 in FIG. 1 extending in a vertical direction. When the second feed roller 32*a* is rotated counterclockwise in FIG. 1 by a driving device, the recording paper P on the top is picked up from the second sheet cassette 32 and transported to the feeding path 33. Alternatively, the recording paper P may be set in a manual sheet-feeding tray 113, similarly to the sheet cassettes 31 and 32. The manual sheet-feeding tray 113 is closeable by pivoting in a direction indicated by arrow shown in FIG. 1. When a third feed roller 112 is rotated clockwise in FIG. 1 by a driving device, the recording paper P on the top is picked up from the manual sheet-feeding tray 113 and is transported to the feeding path 33 through a manual feeding path 111. Multiple transport roller pairs 34 are provided in the feeding path 33, and the recording paper P fed to the feeding path 33 is transported from a lower side to an upper side in the feeding path 33 while being sandwiched between the transport roller pair 34.

A registration roller pair 35 is provided in a downstream end of the feeding path 33. The registration roller pair 35 stops rotating to stop transporting the recording paper P immediately after the recording paper P is sandwiched therebetween. Then, the registration roller pair 35 transports the recording paper P toward a second transfer nip at appropriate timing.

Above the respective process units 1Y, 1C, 1M, and 1K, the transfer unit 40 is provided. Referring now to FIG. 1, the transfer unit 40 includes the intermediate transfer belt 41 that is a seamless (endless) belt and is moved seamlessly in a clockwise direction shown in FIG. 1. The transfer unit 40 further includes a belt-cleaning unit 42, a first bracket 43, a second bracket 44, four primary transfer rollers 45Y, 45C, 45M, and 45K, a secondary transfer backup roller 46, a driving roller 47, a driving support roller 48, and a tension roller 49, besides the intermediate transfer belt 41. The intermediate transfer belt 41 is looped around and supported by these eight rollers 45Y, 45C, 45M, 45K, 46, 47, 48, and 49 and is seamlessly rotated by the driving roller 47 in counterclockwise direction in FIG. 1. The four primary transfer rollers 45Y, 45C, 45M, and 45K and the photoreceptors 3Y, 3C, 3M and 3K sandwich the intermediate transfer belt 41 to form respective primary transfer nips. A primary transfer bias whose polarity (for example, positive polarity) is opposite to that of the toner is applied to a rear surface (internal circumferential surface of the loop) of the intermediate transfer belt 41. As the intermediate transfer belt 41 moves to pass the primary transfer nips respectively, the toner images of respective colors formed on the respective photoreceptors 3Y, 3C, 3M, and 3K are primary transferred and superimposed one on another on the intermediate transfer belt 41. Thus, a multicolor toner image is formed on the intermediate transfer belt 41.

The secondary transfer backup roller 46 and a secondary transfer roller 50 that is positioned outside of the loop of the intermediate transfer belt 41 sandwich the intermediate transfer belt 41 to form a secondary transfer nip. The registration roller pair 35 stops the recording paper P by clamping the recording paper P therebetween and then forward the recording paper P to the secondary transfer nip, timed to coincide with the arrival of the multicolor toner image formed on the intermediate transfer belt 41. The four color toner image on the intermediate transfer belt 41 is secondary transferred onto the recording paper P at once due to the effect of a nip pressure generated in the secondary transfer nip and a secondary magnetic field formed between the secondary transfer backup roller 46 and the secondary transfer roller 50 to which a secondary transfer bias is applied. Thus, the multicolor toner (full-color toner) is formed on the white colored recording paper P.

Herein, un-transferred toner remains on the surface of the intermediate transfer belt 41 after the intermediate transfer belt 41 passes through the secondary transfer nip. The belt-cleaning unit 42 removes the un-transferred toner. In the belt cleaning unit 42, a cleaning blade 42*a* contacts an outer surface of the intermediate transfer belt 41 to scrap off the residual un-transferred toner on the intermediate transfer belt 41.

A fixing unit 60, serving as a fixing device, is provided above the secondary transfer nip. The fixing unit 60 includes a fixing belt unit 62 and a pressure heating roller 61 including a heating source, such as, a halogen lamp. The fixing belt unit 62 includes a fixing belt 64, a heating roller 63 including a heating source such as a halogen lamp, a tension roller 65, and a driving roller 66. The seamless fixing belt 64 that is looped around the heating roller 63, the tension roller 65, and the driving roller 66 is rotated in a counterclockwise direction in FIG. 1. In the process of seamless moving, the fixing belt 64 is heated from backside. A heated portion of the fixing belt 64 facing the heating roller 63 from backside contacts the pressure heating roller 61 that is rotated in a clockwise direction in FIG. 1. Thus, a fixing nip is formed by contacting the pressure heating roller 61 and the fixing belt 64.

The recording paper P after being passed through the secondary transfer nip is separated from the intermediate transfer belt 41 and then is sent into the fixing unit 60. In a process of transporting the recording paper P from a lower side to an upper side in the fixing unit 60, the unfixed four-color toner image form on the recording paper P is fixed on the surface of the recording paper P with heat and pressure by the fixing belt 64. Thus, the four-color toner image is fixed on the recording paper P.

Then, the recording paper P after fixing process is discharged by a pair of discharge rollers 67 outside the apparatus body 201. A stack tray 68 is formed on an upper portion of the apparatus body 201. The recording paper P discharged outside the apparatus body 201 is subsequently stacked on the stack tray 68 by the discharge roller pair 67.

In addition, a reversing unit 70 is provided on one end of the apparatus body 201 (right side end shown in FIG. 1). The reversing unit 70 includes reversing rollers 71 and the manual sheet-feeding tray 113. The reversing unit 70 can pivot and open in a direction indicated by broken line arrow in FIG. 1 to remove a jammed recording paper in the apparatus body 201 when the recording paper P is jammed. The reversing unit 70 reverses the recording paper P and again sends the recording paper P to the secondary transfer nip through a reverse path 72 to print the images on both side of the recording paper P (duplex printing).

Above the transfer unit 40, four toner cartridges 100Y, 100C, 100M, and 100K for containing yellow, magenta, cyan, and black toners, respectively, are installed in the apparatus body 201. The toner contained in the toner cartridges 100Y, 100C, 100M, and 100K is supplied to the development unit 7Y, 7C, 7M, and 7K, respectively. The toner cartridges 100Y, 100C, 100M, and 100K are removably installed in the apparatus body 201 independently from the process units 1Y, 1C, 1M, and 1K. It is to be noted that, in the process unit 1, reference character suffixes Y, C, M, and K attached to identical reference numerals indicate only that components indicated thereby are used for forming different single-color images, respectively, and hereinafter may be omitted when color discrimination is not necessary.

Next, a feature of the present disclosure is described below.

FIG. 5 is a schematic diagram illustrating a vicinity of the photoreceptor 3 and the charging roller 6. The charging roller 6 functions as a rotary body. As illustrated in FIG. 5, a shaft 6*a* of the charging roller 6 is rotatably supported by a bearing 110. One shaft end 6*b* (left side shown in FIG. 5) in the shaft 6*a* of the charging roller 6 is shaped spherically. The spherical shaft end 6*b* contacts an electrode 160 that is connected to the power supply 170. The bearing 110 that supports the shaft 6*a* of the charging roller 6 is made of only plastic material that does not contain electrically conductive material.

First Embodiment

Figure 6:
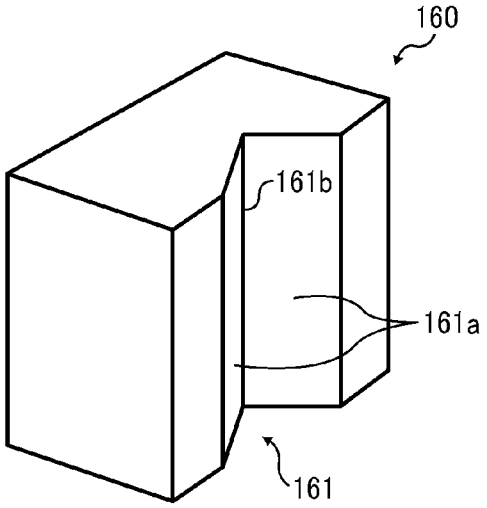
FIG. 6 is a perspective view of an electrode in the connector according to a first embodiment.
Figure 7:
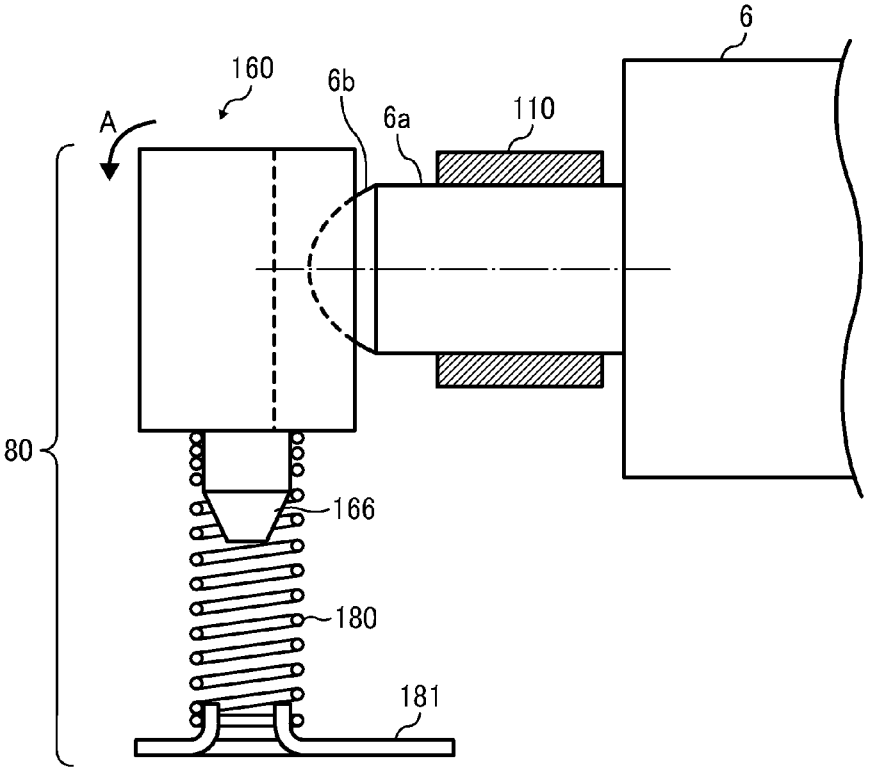
FIG. 7 is an expanded end-on view illustrating a contact state in which the charging roller contacts the connector including the electrode and a coil spring.
Figure 8:
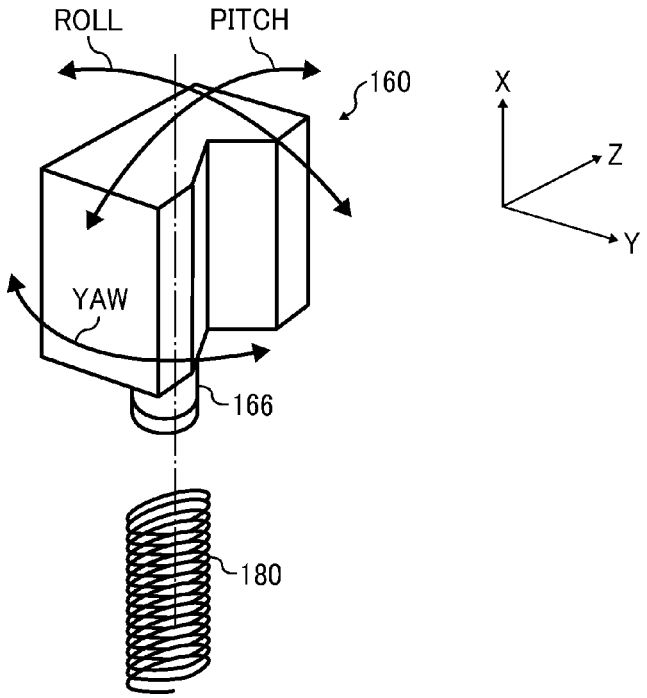
FIG. 8 is an exploded perspective diagram illustrating the electrode and the coil spring shown in FIG. 7.

FIG. 6 is a perspective view of the electrode 160, FIG. 7 is an expanded diagram of vicinity of the electrode 160 and the shaft 6*a* of the charging roller 6, and FIG. 8 is an exploded perspective view illustrating the electrode 160 and a coil spring 180. The electrode 160 and the coil spring 180 together constitute a connector 80. As illustrated in FIG. 7, the connector 80 electrically connects the charging roller 6 serving as the rotary body and the power supply 170. The electrode 160, functions as a connecting terminal, contacts the shaft 6*a* of the charging roller 6 at two points. The coil spring 180, functions as a posture adjuster, adjusts posture of the electrode 160 to keep the electrode 160 in contact with the charging roller 6. The electrode 160 is made of an electrically conductive resin containing electrically conductive material such as carbon black, or metal. The electrode 160 has a symmetrical V-shaped groove 161 in one face thereof that is V-shaped in cross section.

As illustrated in FIG. 7, the coil spring 180 holds the electrode 160. More specifically, a projection 166 is provided in the electrode 160, and by inserting and fitting the projection 166 into the spiral coil spring 180, the electrode 160 is held by the coil spring 180. The other end of the coil spring 180 opposite to an insertion end of the electrode 160 is attached to a spring supporter 181 that is provided in the apparatus body 201. Since the electrode 160 is such held by the coil spring 180, the posture of the electrode 160 can be changed around an X axis (vertical axis), a Y axis (lateral axis), and a Z axis (longitudinal axis) as shown in FIG. 8. More specifically, when the coil spring 180 twists and transforms, the electrode 160 can be yawed around the X axis. When the coil spring 180 leans in a Y-axis direction, the electrode 160 can be rolled around the Z axis. When the coil spring 180 leans in a Z-axis direction, the electrode 160 can be pitched around the Y axis. Since the electrode 160 is supported by the coil spring 180 in this way, it becomes possible to change the posture of the electrode 160 around the X axis, the Y axis, and the Z axis. Thus, the shaft end 6*b* of the charging roller 6 can contact two internal sloped faces 161*a* of the V-shaped groove 161 in the electrode 160. In the present embodiment, by twisting and the transforming the coil spring 180, the posture of the electrode 160 can be changed (yawed) around the X axis. That is, in a configuration in which the projection 166 of the electrode 160 is relatively tightly fit in the coil spring 180, the coil spring 180 twists and transports to rotate (yaw) the electrode 160 around the X axis. In an alternative configuration, by holding the electrode 160 rotatably in the coil spring 180, the posture of the electrode 160 may be changed around the X axis. That is, in a configuration in which the projection 166 of the electrode 160 is rotatably (loosely) inserted into the coil spring 180, the electrode 160 can be rotated around the coil spring 180 as an axis of rotation in a horizontal direction (around the X axis).

Referring back to FIG. 7, when the shaft end 6*b* of the charging roller 6 comes to contact the electrode 160, the coil spring 180 holding the electrode 160 bents to a direction in which electrode 160 is moved away from the charging roller 6, and the electrode 160 leans to (rolled) in a direction indicated by arrow A. Accordingly, the coil spring 180, serving as the posture adjuster, causes the electrode 160 to contact the shaft end 6*b* of the charging roller 6 in a state in which the electrode 160 is pressed to the charging roller 6 side by the coil spring 180.

Although the contact between the electrode 160 and the shaft end 6*b* of the charging roller 6 is kept by holding the electrode 160 by the coil spring 180 and adjusting the posture of the electrode 160 in the present embodiment, alternatively, the contact between the electrode 160 and the shaft end 6*b* of the charging roller 6 may be kept by changing posture of the charging roller 6. In addition, although the electrode 160 is pressed to the charging roller 6 side by the coil spring 180 in the present embodiment, the charging roller 6 may be pressed to the electrode 160 side.

Figure 9:
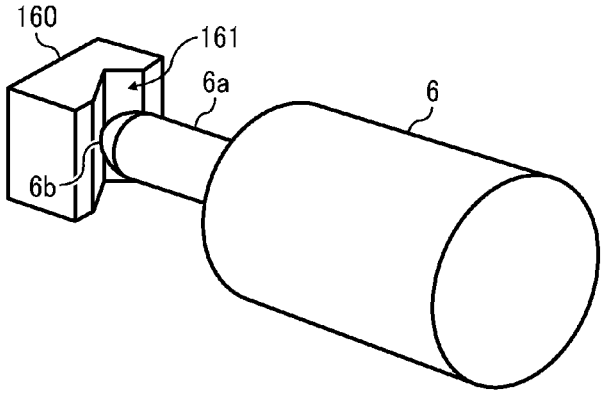
FIG. 9 is a perspective diagram illustrating a contact state in which a shaft end of the charging roller contacts the electrode shown in FIG. 6.
Figure 10:
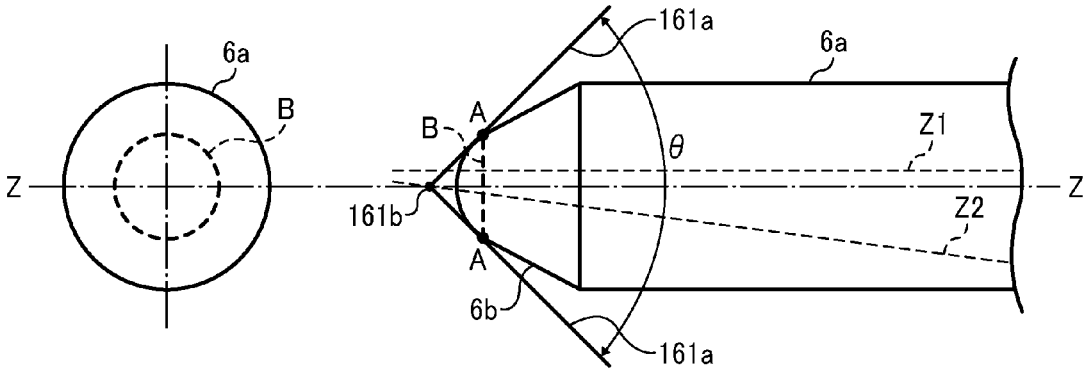
FIG. 10 is a pattern diagram illustrating a contact state in which the shaft end of the charging roller contacts the electrode shown in FIG. 6.

FIG. 9 is a perspective diagram illustrating a state in which the shaft end 6*b* of the charging roller 6 contacts the electrode 160. FIG. 10 is a pattern diagram illustrating a state in which the shaft end 6*b* of the charging roller 6 contacts the electrode 160. As illustrated in FIGS. 9 and 10, the shaft end 6*b* of the charging roller 6 contacts the sloped faces 161*a* of the V-shaped groove 161 in the electrode 160. In an case, if a shaft centerline Z of the charging roller 6 is displaced relative to a groove centerline passing through a deepest point 161*b* of the V-shaped groove 161 as indicated by broken line Z1 when the electrode 160 comes to contact the shaft end 6*b* of the charging roller 6, the shaft end 6*b* of the charging roller 6 contacts one of the two sloped faces 161*a* in the electrode 160 at single point. If external substance, such as trash, is caught between the electrode 160 and the shaft end 6*b*, electrically-conducting failure may occur.

However, in the present embodiment, as illustrated in FIG. 7, since the electrode 160 is held by the coil spring 180, in a state in which the electrode 160 contacts the shaft end 6*b* of the charging roller 6, even when the shaft centerline Z of the charging roller 6 is displaced (see broken line Z1) relative to the groove centerline passing through the deepest point 161*b* of the V-shaped groove 161, the electrode 160 is yawed around the X axis by twisting and transforming the coil spring 180, and the electrode 160 moved toward the Z-axis direction by bending (pitching) the coil spring 180 along the Z-axis direction. As a result, both sloped shapes 161*a* of the V-shaped groove 161 can contact the shaft end 6*b* of the charging roller 6. More specifically, when the charging roller 6 is moved relatively toward the electrode 160 from a state in which the one of the sloped face 161*a* of the V-shaped groove 161 in the electrode 160 contacts the shaft end 6*b* of the charging roller 6, the shaft end 6*b* of the charging roller 6 presses one of the sloped face 161*a* of the electrode 160. At this time, the electrode 160 is rotated (yawed) around the X axis by twisting and transforming the coil spring 180, and the electrode 160 is moved toward the Z-axis direction by bending (pitching) the coil spring 180 around the Y axis. As a result, the other sloped face 161*a* of the V-shaped groove 161 can come to contact the shaft end 6*b* of the charging roller 6.

In another case, if the shaft centerline Z of the charging roller 6 is inclined (see broken line Z2) relative to the groove centerline passing through the deepest point 161*b* of the electrode 160 when the shaft end 6*b* of the charging roller 6 comes to contact the electrode 160, the shaft end 6*b* of the charging roller 6 becomes to a state in which the shaft end 6*b* contacts one of the sloped faces 161*a* of the electrode 160. In this case, the charging roller 6 is moved relatively toward the electrode 160 from the state in which the shaft end 6*b* of the charging roller 6 contacts the one of the sloped face 161*a* of the V-shaped groove 161 in the electrode 160, the electrode 160 is rotated (pitched) so that the both sloped faces 161*a* of the V-shaped groove 161 can come to contact the shaft end 6*b* of the charging roller 6.

Thus, in this embodiment, the coil spring 180 holds the electrode 160 so that the electrode 160 can contact the shaft end 6*b* of the charging roller 6 at two points.

Accordingly, two power supply routes (electronic power supply paths) can be formed by a single the electrode 160. Therefore, even when the electrically-conducting failure may occur in one of the contact portions between the one of sloped face 161*a* of the V-shaped grooves 161 and the shaft end 6*b*, the electrically conductive state in the other of the contact portion between the other of the sloped faces 161*a* and the shaft end 6*b* can be kept. More specifically, if the foreign substance is caught between one of the sloped faces 161*a* of the V-shaped groove 161 and the shaft end 6*b*, one of the sloped faces 161*a* is separated away from the shaft end 6*b* for thickness of the foreign substance. That is, a clearance gap is generated therebetween. Since the electrode 160 is pressed to the charging roller 6 side by the coil spring 180, if the clearance gap is generated, the electrode 160 is shaken (is rotated) around the X axis (yawed in the horizontal direction) due to the pressing force of the coil spring 180. Then, the contact between the other of the sloped faces 161*a* of the V-shaped groove 161 and the shaft end 6*b* of the charging roller 6 can be kept. Accordingly, even when the foreign substance is caught between one of the sloped faces 161*a* of the V-shaped groove 161 and the shaft end 6*b*, the contact between the other of the sloped faces 161*a* of the V-shaped groove 161 and the shaft end 6*b* of the charging roller 6 can be kept, which can maintain the electrically conductive state. With this configuration, the power supply 170 can stably apply the charging bias (predetermined voltage) to the charging roller 6 via the connector 80, comparing to a connector having a single power supply route.

Thus, since the two supply routes can be ensured by using a single electrode 160, the wiring route from the power supply 170 to the electrode 160 can be set only one. Accordingly, the wiring space for wiring route in the present embodiment can be reduced, compared to a configuration in which the two wiring route (power supply route) is formed by using an electrically conductive member such as bearing, that is different from the electrode. Therefore, the size of the connector 80 in the process unit 1 can be reduced. In addition, it is not necessary to provide another electrically conductive member that is different from the electrode 160, which hinders cost increase.

Herein, in the present embodiment, the V-shaped groove 161 of the electrode 160 is set in a gravity direction. In other words, the deepest point 161*b* of the V-shaped groove 161 extends in a gravity direction. With rotation of the charging roller 6, the sloped faces 161*a* are scraped and cutting scrape is generated. By setting the V-shaped groove 161 in the electrode 160 in the gravity direction, the cutting scrap is not retained in the V-shaped groove 161 but is dropped from the electrode 160. Thus, getting the electrically conductive state between the sloped faces 161*a* and the shaft end 6*b* unstable by clogging the cutting scrap in the contact point A (see FIG. 10) therebetween can be eliminated.

Variation 1

Figure 11:
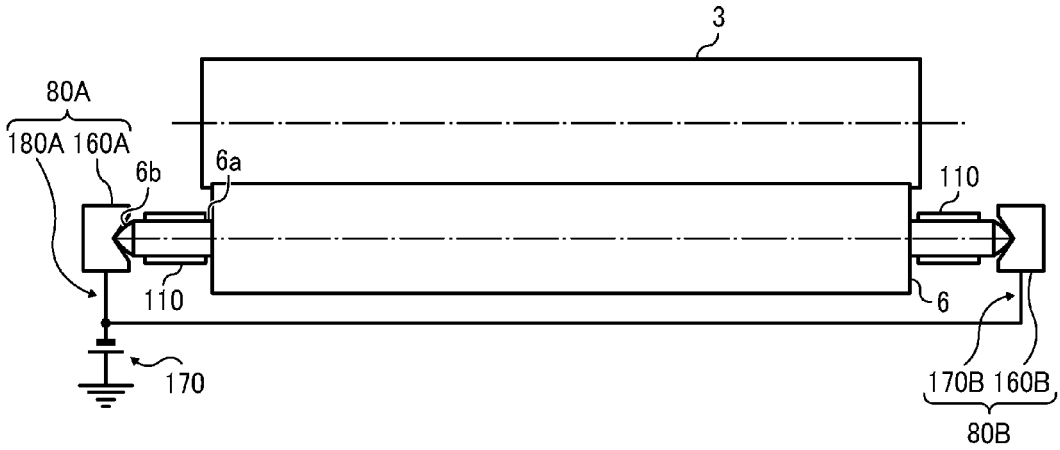
FIG. 11 is a schematic diagram illustrating a configuration in which two electrodes are provided in both ends of the charging roller as a variation of the first embodiment.
Figure 12:
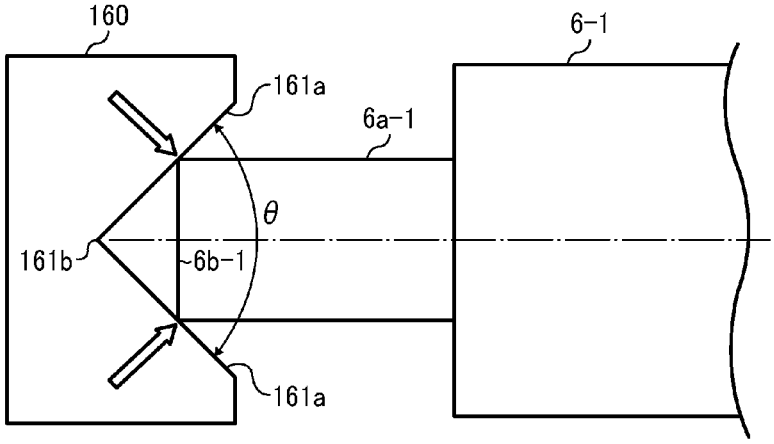
FIG. 12 is a pattern diagram illustrating a contact state in which a flat shaft end of the charging roller contacts the electrode as another variation of the first embodiment.

Herein, although the electrode 160 is provided in one side end of the charging roller 6 as shown in FIG. 5 in the present embodiment, the electrode 160 may be provided both side ends of the charging roller 6 as shown in FIG. 11 as a variation. In other words, the charging device 5Y further includes a second connector 80B to contact the other end 6*b* of the charging roller 6. The process unit 1 includes a first connector 80A including a first electrode 160A and a first coil spring 180A and the second connector 80B including a second electrode 160B and a second coil spring 180B. With this configuration, four electric power supply routes from the supply device 170 to the charging roller 6 can be formed, which can be made more stable power supply.

Variation 2

In addition, although the shaft end 6*b* of the charging roller 6 that contacts the electrode 160 is formed spherical in FIG. 10, the face of the shaft end 6*b* is not limited to the spherical. As another variation illustrated in FIG. 12, in a state in which the shaft end 6*b* is not spherical but a flat face, the sloped faces 161*a* of the V-shaped groove 161 can contact a flat shaft end 6*b*-1 of the charging roller 6 at two points.

Variation 3

As described above, although the charging roller 6 is used as the rotary body to which the power voltage (bias) is supplied from the power supply 170 through the electrode 160 in the connector 80, the primary transfer rollers 45Y, 45C, 45M, and 45K, the development roller 12, and the secondary transfer roller 50 may be also adapted as the rotary body to which the bias is applied from the power supply 170 through the electrode in the connector 80. In an alternative configuration, the connector 80 according to the present disclosure can be also adapted for connecting the above-described rotary body with a ground voltage (ground terminal) instead of the power supply 170 when a voltage of the rotary body is dropped to the ground voltage.

Variation 4

Figure 13:
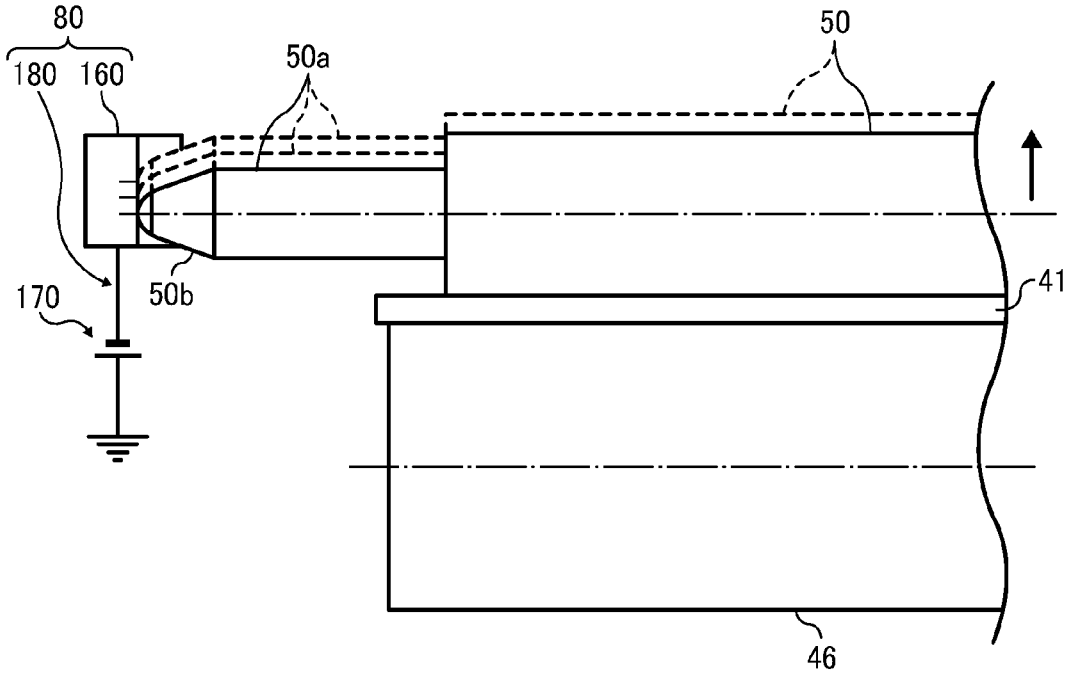
FIG. 13 is a diagram illustrating the connector, the power supply, and a secondary transfer roller that is moved in a direction orthogonal to a shaft thereof, as a variation of the first embodiment.

In yet another variation, FIG. 13 is a schematic diagram illustrating the connector 80 to connect the secondary transfer roller 50 serving as the rotary body and the power supply 170 and apply the secondary transfer bias from the power supply 170 to the secondary transfer roller 50. As illustrated in FIG. 13, when the recording paper P is entered into the secondary transfer nip, the secondary transfer roller 50 is moved away from the secondary transfer belt 41 for thickness of the recording paper P.

Accordingly, when the electrode 160 is used for the secondary transfer roller 50, the V-shaped groove 161 is formed in the electrode 160 in a direction in which the secondary transfer roller 50 is moved. That is, in a configuration in which a shaft 50*a* of the rotary body (second transfer roller 50) is movable in a direction orthogonal to the shaft 50*a* of the rotary body 50, the V-shaped groove 161 is opened so that the two points of an end face 50*b* of the shaft 50*a* of the rotary body 50 slides along the two internal sloped faces 161*a* of the V-shaped groove 161 as the shaft 50*a* of the rotary body 50 is moved. Thus, the shaft end 50*b* of the secondary transfer roller 50 can continue to contact the sloped faces 161*a* of the electrode 160 while the secondary transfer roller 50 can be moved away (lift) from the secondary transfer belt 41, which can maintain the electrically conductive state.

Second Embodiment

Next, an electrode 260 according to a second embodiment is described below, with reference to FIGS. 14 through 16.

Figure 14:
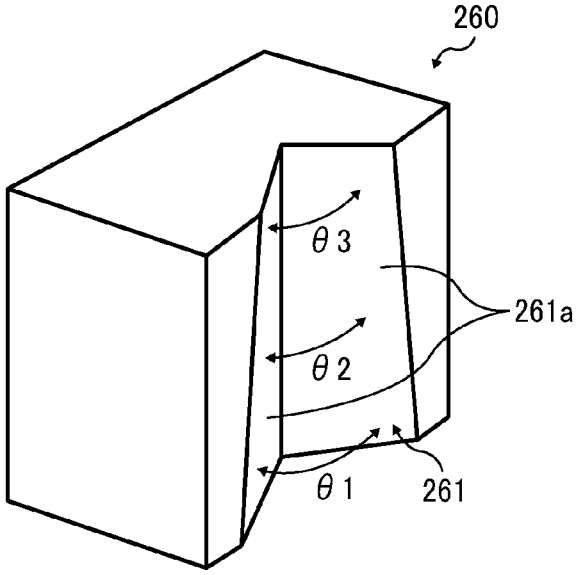
FIG. 14 is a schematic diagram illustrating an electrode according to a second embodiment.

FIG. 14 is a perspective view illustrating the electrode 260 according to the second embodiment. In the electrode 260 shown in FIG. 14, a groove angle of sloped faces 261*a* of V-shaped groove 261 is different along the V-shaped groove 261. In other words, in a state in which the end 50*b* of the shaft 50*a* of the rotary body 50 has a spherical shape in cross section, the V-shaped groove 261 has a groove angle that widens or narrows in the direction in which the shaft 50*a* of the rotary body 50 is movable. The groove angle is an angle sandwiched between both sloped faces 261*a*. The configuration of the electrode 260 is preferably used for a connector to connect the rotary body that moves in a direction orthogonal to a shaft itself, for example, the secondary transfer roller 50.

Figure 15A:
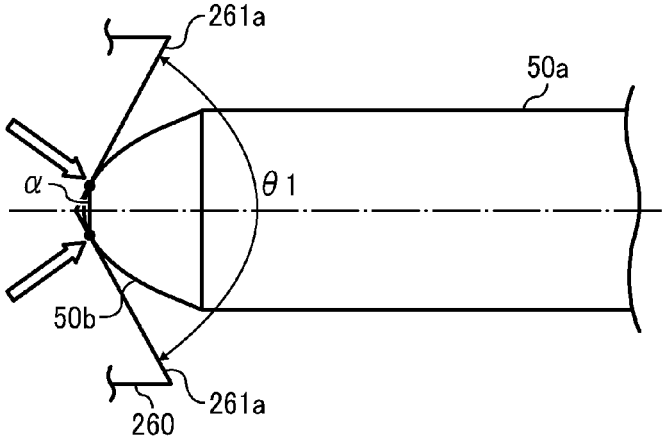
FIGS. 15A through 15C are pattern diagrams illustrating contact states in which a shaft end of the second transfer roller contacts the electrode shown in FIG. 14.
Figure 15B:
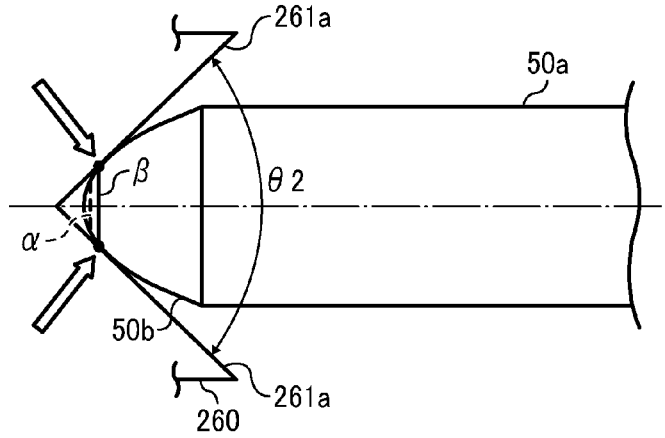
Figure 15C:
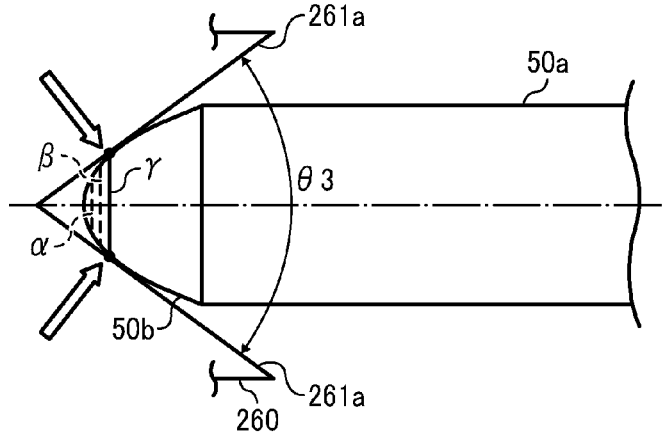
Figure 16:
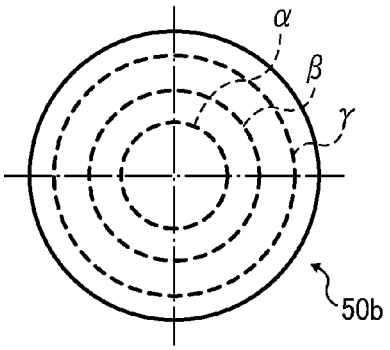
FIG. 16 is an end-on diagram illustrating contact portions of the shaft end contacting sloped faces of the V-shaped groove in the electrode shown in FIG. 14.

FIGS. 15A through 15C are pattern diagrams illustrating contact states in which the electrode 260 contacts the shaft end 50*b* of the secondary transfer roller 50. FIG. 15A shows a contact state when the recording paper P is not entered in the secondary transfer nip. FIG. 15B shows a contact state when a normal paper as the recording paper P is entered in the secondary transfer nip. FIG. 15C shows a contact state when a cardboard as the recording paper P is entered in the secondary transfer nip. FIG. 16 shows contact positions of the shaft end 50*b* contacting the sloped faces 261*a* of the V-shaped groove 261.

In FIG. 15A, when the recording paper P is not entered in the secondary transfer nip, the shaft end 50*b* of the secondary transfer roller 50 contacts a portion of the sloped faces 261*a* whose groove angle θ1 is relatively wider in the V-shaped groove 261 illustrated in a lower portion of the electrode 260 in FIG. 14. At this time, a position indicated by a broken line α in FIG. 16 of the shaft end 50*b* of the secondary transfer roller 50 contacts the sloped faces 261*a* of the V-shaped groove 261.

As illustrated in FIG. 15B, when the normal sheet is entered in the secondary transfer nip, the secondary transfer roller 50 is moved upward (lifted up) to separate away from the secondary transfer belt 41 for the thickness of the recording paper P. As a result, the shaft end 50*b* of the secondary transfer roller 50 is moved from the lower portion to a center portion of the V-shaped groove 261 in the electrode 260 while contacting the sloped faces 261*a* of the V-shaped groove 261. Since the shaft end 50*b* of the secondary transfer roller 50 contacting the sloped faces 261*a* is shaped spherical, when the shaft end 50*b* of the secondary transfer roller 50 is moved from the lower portion to the center portion of the V-shaped groove 261 whose groove angle θ2 is narrower than the groove angle θ1, a contact position β of the sloped face 261*a* contacting the shaft end 50*b* is changed outward. That is, in a state in which the recording paper P is not entered in the secondary transfer nip, the position α of the shaft end 50*b* contacts the sloped faces 261*a* of the V-shaped groove 261. In a state in which the normal paper is entered in the secondary transfer nip, the position β of the shaft end 50*b* positioned outer than the position α thereof contacts the sloped faces 261*a* of the V-shaped groove 261.

In addition, as illustrated in FIG. 15C, when the a cardboard is entered in the secondary transfer nip, the secondary transfer roller 50 is moved further upward of the sloped faces 261*a* of the V-shaped groove 261 whose groove angle θ3 is further narrower than the groove angle θ2 in the center portion. As a result, a position γ, that is positioned outer than the position β, of the shaft end 50*b* of the secondary transfer roller 50 contacts the sloped face 261*a* of the V-shaped groove 261.

Thus, because the groove angles (θ1, θ2, θ3) of the V-shaped groove 261 of the electrode 260 are set be gradually changed along the V-shaped groove 261, when the secondary transfer roller 50 is moved upward for the thickness of the recording paper P, the contact portions of the sloped faces 261*a* of the V-shaped groove 261 contacting the spherical shaft end 50*b* can be changed. Namely, the contact positions (α, β, γ) of the shaft end 50*b* of the secondary transfer roller 50 contacting the sloped faces 261*a* can be changed in accordance with the thickness of the recording paper P. Therefore, in the present embodiment, comparing to a configuration in which a single position of the sloped face 161 always contacts a predetermined single position of the shaft end 50*b* of the secondary transfer roller 50, the abrasion of the shaft end 50*b* can be eliminated, which causes superior durability of the secondary transfer roller 50. In addition, if the foreign substance is caught between the shaft end 50*b* and the sloped faces 261*a*, the foreign substance therebetween can be dropped by changing the contact positions (α, β, γ) of the shaft end 50*b* contacting the sloped faces 261*a*, which can recover the electrically conductive state in the contact portion therebetween.

Third Embodiment

Figure 17:
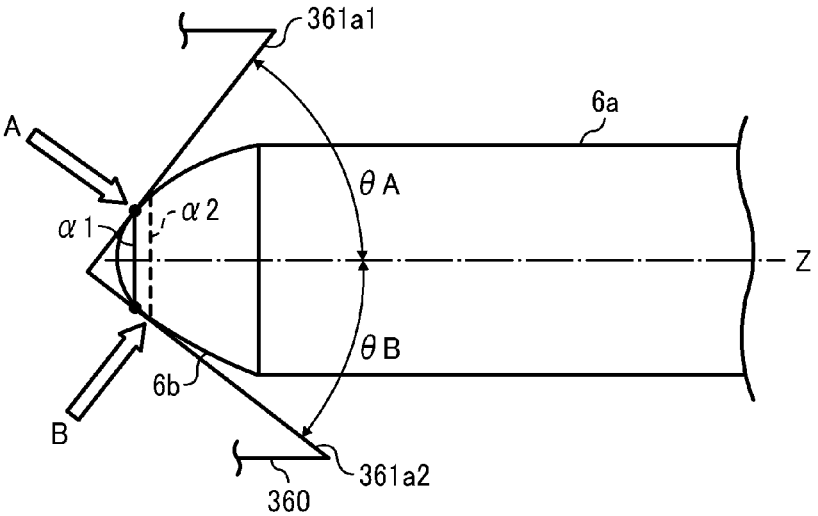
FIG. 17 is a pattern diagram illustrating a contact state in a state in which the shaft end of the charging roller and an electrode according to a third embodiment.
Figure 18:
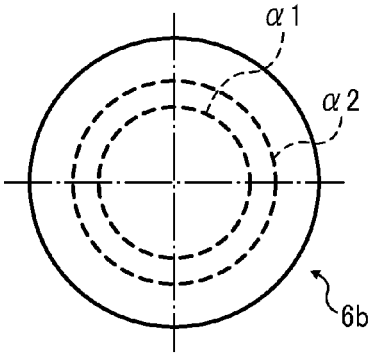
FIG. 18 is an end-on diagram illustrating contact portions of the shaft end contacting sloped faces of a V-shaped groove in the electrode shown in FIG. 17.

FIG. 17 is a pattern diagram illustrating a contact state between the shaft end 6*b* of the charging roller 6 and an electrode 360 according to a third embodiment. FIG. 18 is a side view of the shaft end 6*b* illustrating contact positions of a shaft end 6*b* contacting sloped faces 361*a*1 and 361*a*2 of a V-shaped groove 361 according to the present embodiment. In the electrode 360 shown in FIG. 17, both sloped faces 361*a*1 and 361*a*2 have different bevel angles. The bevel angle is an angle between each of the sloped faces 361*a*1 and 361 *a*2 and the shaft centerline Z of the charging roller 6. A first bevel angle between a first sloped face 361*a*1 and the shaft centerline Z of the charging roller 6 is set to θA, and a second bevel angle between a second sloped face 361*a*2 and the shaft centerline Z of the charging roller 6 is set to θB. Herein, since the shaft end 6*b* of the charging roller 6 is shaped spherical, a contact position, indicated by a broken line α1, of the shaft end 6*b* contacts the first sloped face 361*a*1, and a contact position, indicated by a broken line α2, of the shaft end 6*b* contacts the second sloped face 361*a*2. That is, in a state in which the end face 50*b* of the shaft of the rotary body (charging roller) 6 has a spherical shape in cross section, the first bevel angle θA between the first sloped face 361*a*1 and the shaft centerline Z of the rotary body 6 is set different from the second bevel angle θB between the second sloped face 361*a*2 between the shaft centerline Z of the rotary body 6. Thus, because the first bevel angle θA of the first sloped face 361*a*1 is different from the second bevel angle θB of the second sloped face 361*a*2, contact portions (A, B) of the sloped faces 361*a*1 and 361*a*2 contacting the spherical shaft end 6*b* can be changed each other. Namely, the contact positions (α1 and α2) of the shaft end 6*b* contacting the sloped faces 361*a*1 and 361*a*2 can be changed each other. Therefore, in the present embodiment, compared to the configuration in which the both sloped faces 161*a* contact same position of the shaft end 6*b*, the abrasion of the shaft end 6*b* scraped against the sloped faces 361*a*1 and 361*a*2 can be decreased by half.

As a variation of the third embodiment, an electrode 460 of this variation has a feature that the electrode 360 in which the bevel angles of the sloped faces 361*a*1 and 361*a*2 are different each other and a feature of the electrode 260 according to the second embodiment that the groove angle of the sloped faces 261*a* of the V-shaped groove 261 is gradually changed along the V-shaped groove 261.

Figure 19A:
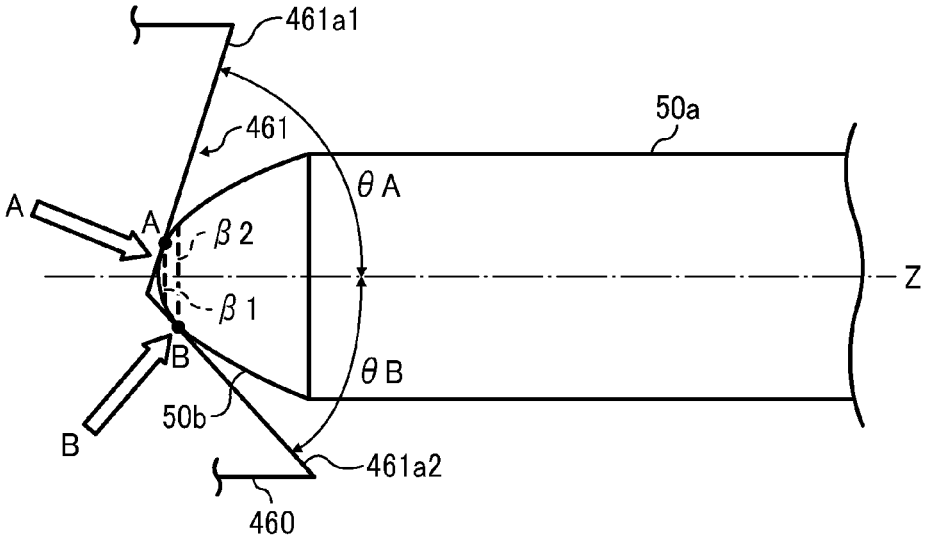
FIGS. 19A and 19B are pattern diagrams illustrating contact states in which a shaft end of the second transfer roller and the electrode as a variation of the third embodiment.
Figure 19B:
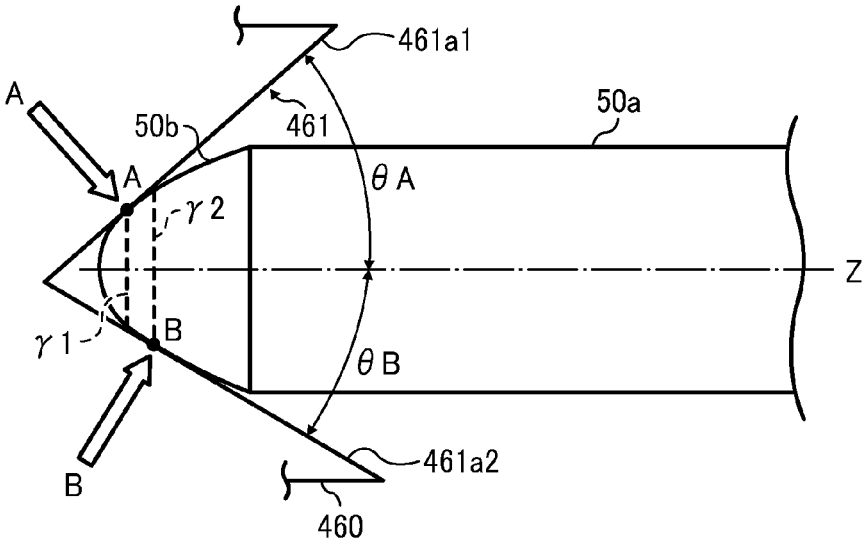

FIGS. 19A and 19B are pattern diagrams illustrating contact state in which shaft end 50*b* of the secondary transfer roller 50 contacts the electrode 460 according to the variation of the third embodiment. FIG. 19A shows a contact state in which the recording paper P is not entered into the secondary transfer nip, and FIG. 19B shows a contact state in which the recording paper P is entered into the secondary transfer nip. As illustrated in FIG. 19A, when the recording paper P is not entered into the secondary transfer nip, a position β1 of the shaft end 50*b* contacts a first sloped face 461*a*1 of a V-shaped groove 461, and a position β2 of the shaft end 50*b* contacts a second sloped face 461*a*2 thereof When the recording paper P is entered into the secondary transfer nip as illustrated in FIG. 19B, the secondary transfer roller 50 is moved upward along the V-shaped groove 461, a contact position of the shaft end 50*b* contacting the first sloped face 461*a*1 is changed from β1 to γ1, and a contact position of the shaft end 50*b* contacting the second sloped face 461*a*2 is changed from β2 to γ2. Therefore, in the present variation, comparing to the configuration in which the both sloped faces 161*a* always contact same position of the shaft end 50*b*, the abrasion of the shaft end 50*b* scraped against the sloped faces 461*a*1 and 461*a*2 can be enormously decreased.

Fourth Embodiment

Figure 20:
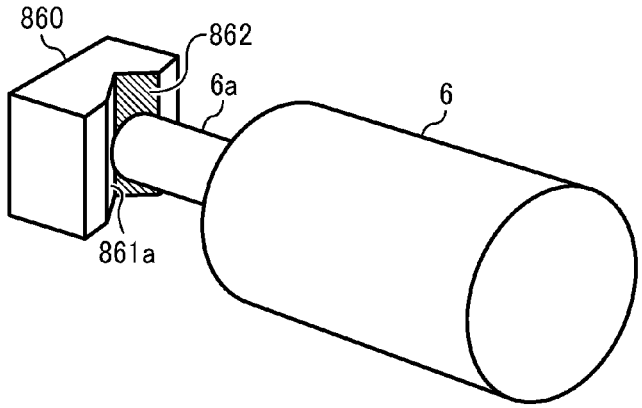
FIG. 20 is a perspective diagram illustrating a contact state in which a shaft end of the charging roller contacts an electrode on which an abrasive portion is provided according to a fourth embodiment.

Next, a connector according to a fourth embodiment is described below with reference to FIGS. 20 through 22. FIG. 20 is a perspective view illustrating a contact state in which the shaft end 6*b* of the charging roller 6 contacts an electrode 860 according to the fourth embodiment.

In a case in which the shaft end 6*b* is used for an extended period of time, the contact portion of the shaft end 6*b* contacting the electrode 160 may get dirty and form a film, which may cause contact failure. In order to solve this problem, in the present embodiment, an abrasive portion 862 is provided on one of sloped faces 861*a* (sloped face 861*a*2) of a V-shaped groove 861. The abrasive portion 862 grinds grime adhered to the contact portion of the shaft end 6*b* contacting the electrode 860 and prevents the film of grime from forming in the contact portion of the shaft end 6*b*.

Figure 21:
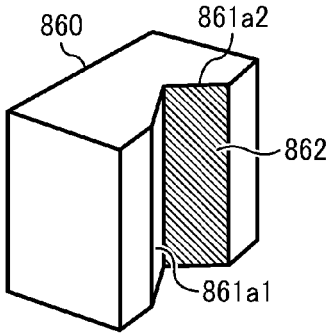
FIG. 21 is a perspective view of the electrode on which the abrasive portion is provided as shown in FIG. 20.

FIG. 21 is a perspective view illustrating the electrode 860. FIG. 22 illustrates an end-on view illustrating the shaft end 6*b* and a pattern diagram illustrating a contact state in which the shaft end 6*b* contacts the electrode 860. In FIGS. 20 through 22, the abrasive portion 862 is provided on the sloped face 861*a*2 of the V-shaped groove 861 in the electrode 860. The abrasive portion 862 is formed by an electrically conductive abrasive sheet to which electrical conductive abrasive is attached is adhered to the sloped face 861*a*2 of the V-shaped groove 861 in the electrode 860. Alternatively, in a configuration in which the electrode 860 is made of electrically conductive resin containing electrically conductive material such as carbon black, the abrasive portion 862 is formed by directly adhering abrasive to the sloped face 861*a*1; more specifically, the abrasive portion 862 is formed by coating electrical abrasive spray on a surface of the sloped face 861*a*2 of the V-shaped groove 861 in a mold of the electrode 860.

Thus, the abrasive portion 862 has electrically conductive by being formed of the electrically conductive material, which can form the power supply route between the charging roller 6 and the sloped face 861*a*2 on which the abrasive portion 862 is formed. Accordingly, similarly the above-described embodiments, the two power supply routes can be formed by a single electrode 860.

Figure 22:
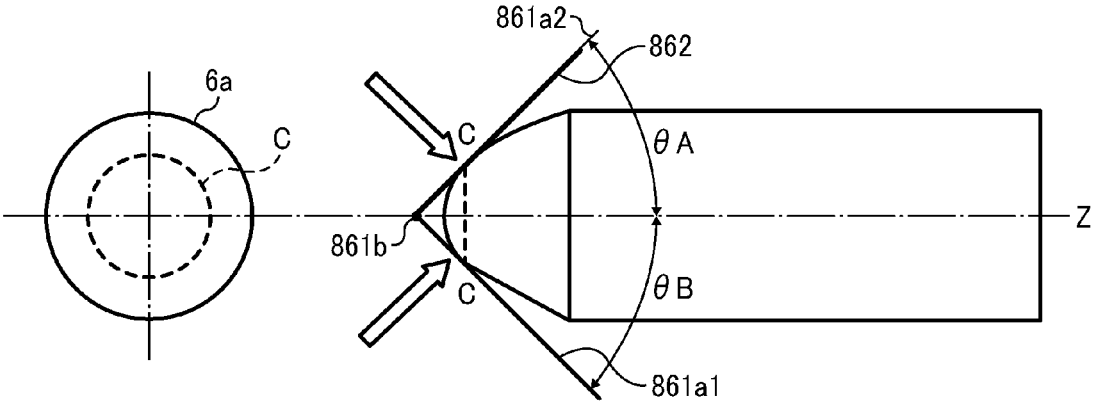
FIG. 22 are pattern diagrams illustrating a contact state in which the shaft end of the charging roller contacts the electrode on which the abrasive portion is provided as shown in FIG. 20.

In addition, as illustrated in FIG. 22, a first bevel angle θA between the sloped face 861*a*2 on which the abrasive portion 862 is formed and the shaft centerline Z of the charging roller 6 is set identical to a second bevel angle θB between a sloped face 861*a*1 on which the abrasive portion 862 is not formed (hereinafter just "smooth sloped face 861*a*1") and the shaft centerline Z of the charging roller 6. Herein, the bevel angle is an angle between the shaft centerline Z of the charging roller 6 and each of the sloped faces 861*a*1 and 861*a*2. The shaft centerline Z of the charging roller 6 passes through a deepest point 861*b* of the V-shaped groove 861 in a state in which the shaft 6*a* suitably contacts the sloped faces 861*a*1 and 861*a*2. Thus, since the first bevel angle θA of the sloped face 861*a*2 on which the abrasive portion 862 is formed is identical to the bevel angle θB of the smooth sloped face 861*a*1, the position of the shaft end 6*b* contacting the abrasive portion 862 is set identical the position of the shaft end 6*b* contacting the smooth sloped faces 861*a*1 on which the abrasive portion 862 is not formed.

Thus, by setting the abrasive portion 862 with such bevel angles, grime adhering to the portion of the shaft end 6*b* contacting the smooth sloped face 861*a*1 in the electrode 860 can be scraped off by the abrasive portion 862. Accordingly, the contact failure caused by forming the grime film in a contact portion C of the shaft end 6*b* contacting the sloped face 861*a*2 can be eliminated.

Variation 1

Figure 23:
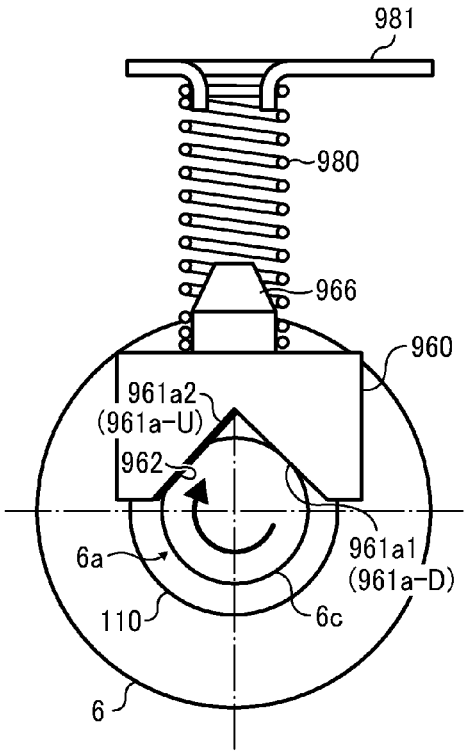
FIG. 23 is a diagram illustrating a configuration in which an electrode on which an abrasive portion is provided contacts an outer circumferential surface of a shaft of the charging roller as a variation of the fourth embodiment.

In the above-described embodiments, the sloped faces 161*a* of the V-shaped groove 161 contacts the shaft end 6*b* of the charging roller 6. However, as a variation of the above-described embodiments, sloped faces 961*a*1 and 961*a*2 of a V-shaped groove 961 in an electrode 960 can contact an outer circumferential surface 6*c* of the shaft 6*a* of the charging roller 6. FIG. 23 is a diagram illustrating a configuration in which the electrode 960 is positioned above the outer circumferential surface 6*c* of the shaft 6*a*of the charging roller 6. The electrode 960 is suspended from above by a coil spring 980 and a spring supporter 981. With this configuration, the two power supply routes can be formed by a single electrode 960. In this variation, even when the foreign substance is caught between the outer circumferential surface 6*c* of the shaft 6*a* and one of the sloped faces of the V-shaped groove 961, the electrode 960 is shaken (rotated) due to the pressing force from the coil spring 980, contact between the other of the sloped faces and the outer circumferential surface 6*c* of the shaft 6*a* of the charging roller 6 can be kept. Therefore, the other of the sloped faces can continue to contact the outer circumferential surface 6*c* when the foreign substance is caught between the outer circumferential surface 6*c* and one of the sloped faces 961*a*1 and 961*a*2 of the V-shaped groove 961, which enables to keep electrically conductive state between the electrode 960 and the charging roller 6. Thus, in the present configuration of the connector, comparing to a connector having a single power supply route, the power supply 170 can supply a charging bias to the charging roller 6 stably.

Variation 2

In addition, an abrasive portion 962 may be provided on one of sloped faces 961*a* (sloped face 961*a*2) of the V-shaped groove 961 in the electrode 960 that contacts the outer circumferential surface 6*c* of the shaft 6*a* of the charging roller 6, as shown in FIG. 23. In this configuration, the abrasive portion 962 is positioned on an upstream sloped face 961*a*-U that is provided upstream from a downstream sloped face 961*a*-D in a direction in which the charging roller 6 is rotated, in consideration of the following problem. For example, unlike the configuration shown in FIG. 23, if the abrasive portion 962 is positioned on the downstream sloped face 961*a*-D, a distance from a portion of the outer circumferential surface 6*c* grind by the abrasive portion 962 to a contact portion of the outer circumferential surface 6*c* contacting a smooth sloped face 961*a*1 on which the abrasive portion 962 is not formed gets longer than the case in which the adhesive portion 962 is positioned on the upstream sloped face 961*a*-U. As a result, the foreign substance may be adhered to the outer circumferential surface 6*c* of the shaft 6*a* until the outer circumferential surface 6*c* arrives at the upstream sloped face 961*a*-U on which the abrasive portion 962 is not formed after the outer circumferential surface 6*c* is grind by the abrasive portion 962. Conversely, in a configuration the abrasive portion 962 is provided on the upstream sloped face 961*a*-U, the outer circumferential surface 6*c* of the shaft 6*a* reaches the contact portion of the outer circumferential surface 6*c* contacting the downstream smooth sloped face 961*a*1 (961*a*-D) on which the abrasive portion 962 is not formed immediately after the outer circumferential surface 6*c* is grind by the abrasive portion 962. Accordingly the foreign substance is less likely be adhered to the outer circumferential surface 6*c*, which eliminates the foreign substance from being caught between the outer circumferential surface 6*c* and the smooth sloped faces 961*a*1 on which the abrasive portion 962 is not formed. In particular, the present configuration is preferable for arrangement in which the electrode 960 is positioned left side in FIG. 23 relative to the shaft 6*a* of the charging roller 6.

In an alternative configuration, the abrasive portion 962 may be positioned on the downstream sloped face 961*a*-D that is provided downstream from the upstream sloped face 961*a*-U in the direction in which the charging roller 6 is rotated, in consideration of the following problem. When the abrasive portion 962 is formed on the upstream-side sloped faces 961*a*-U in a configuration in which the electrode 960 is provided above or right side in FIG. 23 relative to the shaft 6*a*, grind swarf may be caught between the outer circumferential face 6*c* of the shaft 6*a* and the downstream smooth sloped face 961*a*1 (961*a*-D) on which the abrasive portion 962 is not formed, which may render unstable electrically conductive state. In this configuration, when the abrasive portion 962 is formed on the downstream sloped face 961*a*-D, the grinding swarf generated in the contact potion between the abrasive portion 962 of the electrode 960 and the shaft 6*a* is dropped, which prevents the grinding swarf from being moved to the contact portion between the outer circumferential surface 6*c* and the upstream sloped face 961*a*2 (961*a*-U) on which the abrasive portion 962 is not formed. In particular, the present configuration is preferable for arrangements in which the electrode 960 is positioned above or right side relative to the shaft 6*a* of the charging roller 6 shown in FIG. 23.

Fifth Embodiment

Figure 24A:
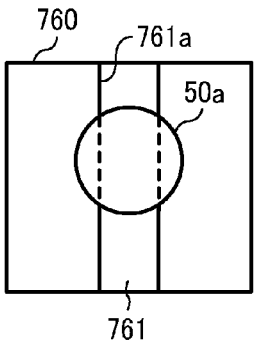
FIGS. 24A and 24B are pattern diagrams illustrating a contact state in which the shaft end of the charging roller contacts an electrode in which a rectangular groove is formed according to a fifth embodiment.
Figure 24B:
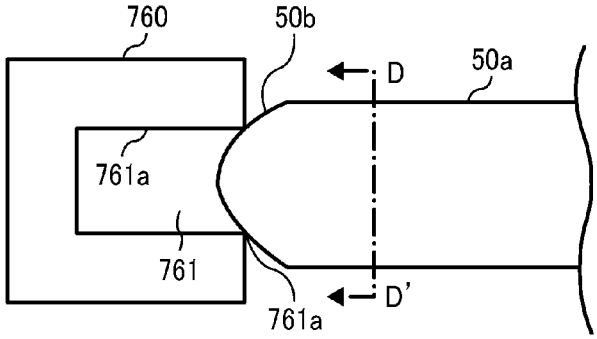

Next, a connector according to a fifth embodiment is described below. FIG. 24A is a diagram around the shaft end 50*b* of the secondary transfer roller 50 and an electrode 760 along a line D-D' in FIG. 24B. FIG. 24B is a pattern diagram illustrating a contact state in which the shaft end 50*b* of the secondary transfer roller 50 contacts the electrode 760 according to the fifth embodiment. In the present embodiment, a rectangular groove 761 is formed in the electrode 760, and the shaft end 50*b* contacts rims 761*a* of the rectangular groove 761. Thus, maintenance of the two power supply routes can be ensured by a single electrode 760. With this configuration, since the rectangular groove 761 is formed (extends) in a direction in which the secondary transfer roller 50 is moved, the secondary transfer roller 50 can be moved while the shaft end 6*b* continues to contact the rims 761*a* of the rectangular groove 761 in the electrode 760 at two points.

Figure 25A:
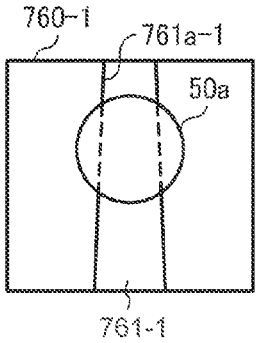
FIGS. 25A and 25B are pattern diagrams illustrating a contact state in which a shaft end of the second transfer roller contacts an electrode in which a rectangular groove of varying width in a direction in which the secondary roller is moved is formed according to a variation of the fifth embodiment.
Figure 25B:
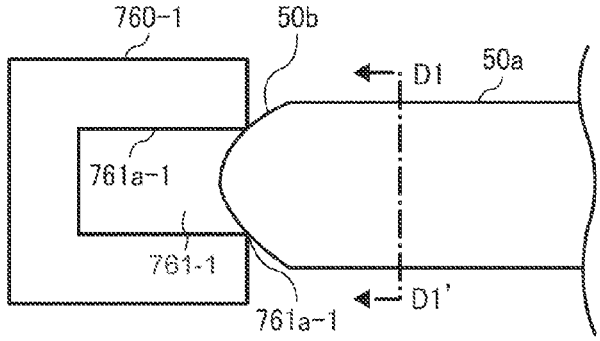

In a variation of the fifth embodiment, a rectangular groove 761-1 of varying width is employed, as illustrated in FIG. 25. FIG. 24A is a diagram around the shaft end 50*b* of the secondary transfer roller 50 and an electrode 760-1 along a line D1-D1' in FIG. 24B, and FIG. 24B is a pattern diagram illustrating a contact state in which the shaft end 50*b* of the secondary transfer roller 50 contacts the electrode 760-1 according to the variation of the fifth embodiment. In this variation, since the width of the groove 761-1 and a distance between the one of rims 761*a*-1 to the other of the rim 761*a*-1 are different in the direction which the secondary transfer roller 50 is moved, the contact position of the shaft end 50*b* contacting the rims 761*a*-1 can be gradually changed when the secondary transfer roller 50 is moved, and then the abrasion of the shaft end 50*b* scraped against the rim 761*a*-1 of the rectangular groove 761-1 can be decreased,

Sixth Embodiment

Figure 26:
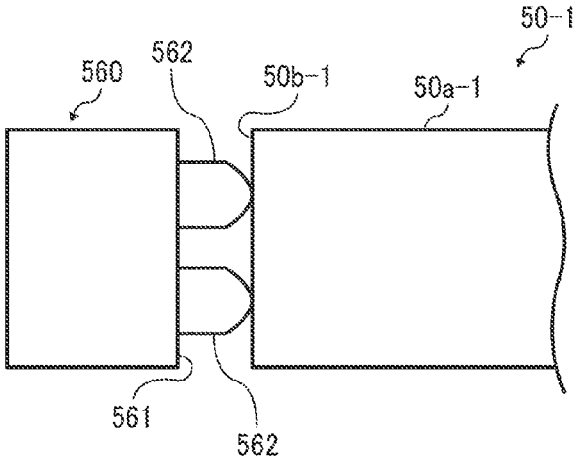
FIG. 26 is a pattern diagrams illustrating a contact state in which a flat shaft end of a second transfer roller contacts an electrode in which two projections are provided according to a sixth embodiment.

FIG. 26 is a top view illustrating a contact state in which a shaft end 50*b*-1 of a secondary transfer roller 50-1 contacts an electrode 560 according to a sixth embodiment. The electrode 560 of the present embodiment includes two projections 562 in a facing surface 561 that faces a shaft end 50*b*-1 (flat end) of the secondary transfer roller 50-1. With this configuration, two power supply routes can be formed by a single electrode 560.

In a variation of the sixth embodiment, in a case in which the rotary body (e.g., the secondary transfer roller 50-1) to contact the electrode 560 is moved in a direction orthogonal to a shaft 50*a*-1, by extending a height of the projections 562, the contact state in which the secondary transfer roller 50-1 continue to contact the projections 562 along two line when the secondary transfer roller 50-1 is moved.

Figure 27:
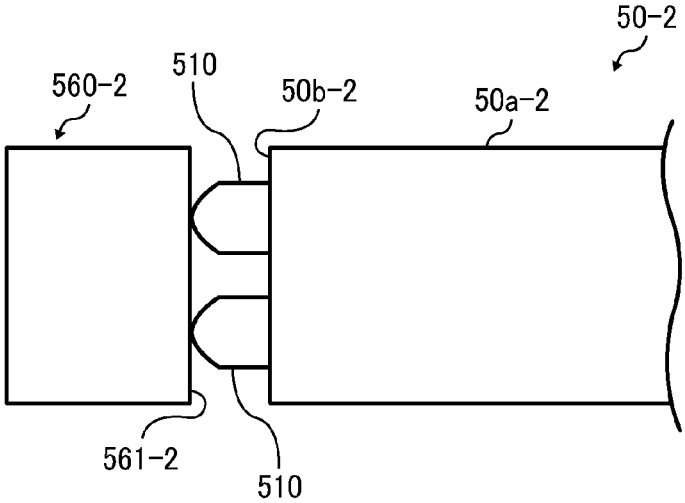
FIG. 27 is a pattern diagrams illustrating a contact state in which a shaft end of a second transfer roller in which two projections are provided on a flat face contacts a flat electrode according to a variation of the sixth embodiment.

In another variation of the sixth embodiment as shown in FIG. 27, a facing surface 561-2 of an electrode 560-2 is flat, and two projections 510 are provided in a shaft end 50*b*-2 of a secondary transfer roller 50-2. With this configuration, two power supply routes can be formed by a single electrode 560-2.

Seventh Embodiment

Figure 28A:
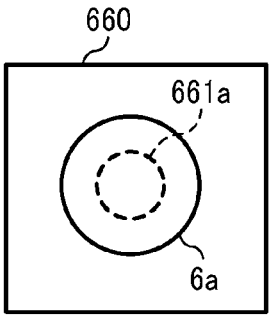
FIGS. 28A and 28B are pattern diagrams illustrating a contact state in which a spherical shaft end of the charging roller contacts an electrode in which a circular hole is formed according to a seventh embodiment.
Figure 28B:
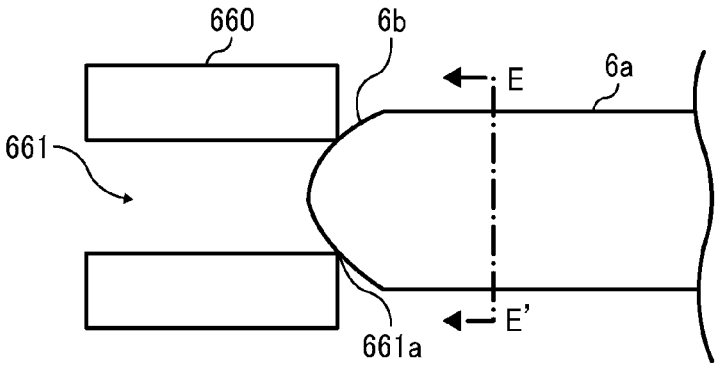
Figure 29A:
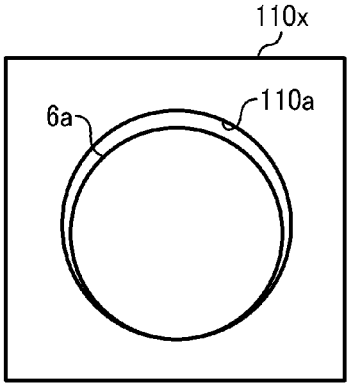
FIG. 29A PRIOR ART
FIG. 29A is a pattern diagram illustrating a shaft of a rotary body and a bearing according a conventional image forming apparatus.
Figure 29B:
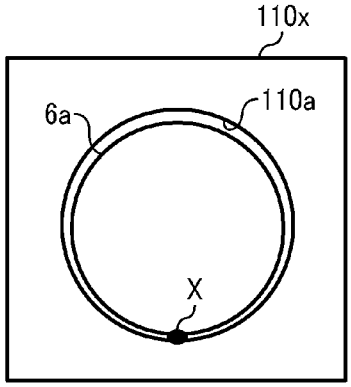
FIG. 29B PRIOR ART
FIG. 29B is a pattern diagram illustrating a state in which a foreign substance is caught in a contact portion between the shaft of the rotary body and the bearing shown in FIG. 29A.
Figure 30:
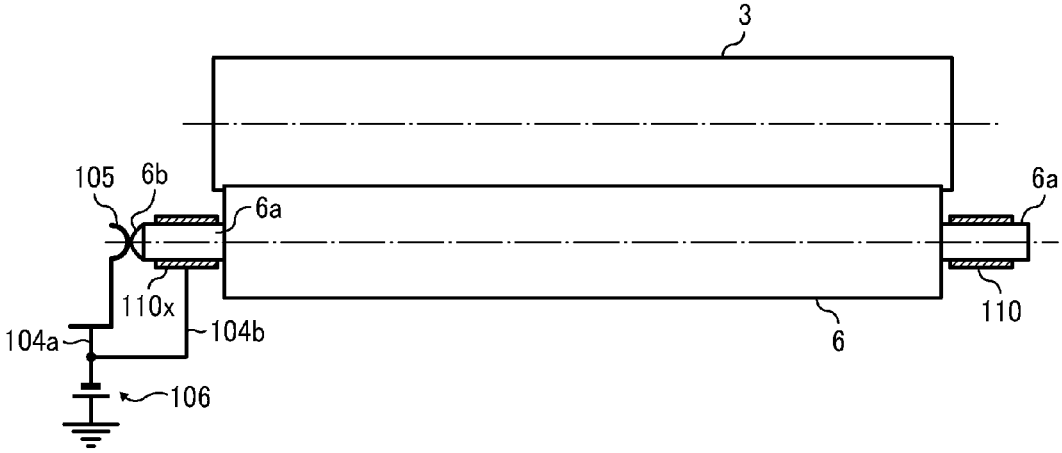
FIG. 30 PRIOR ART
FIG. 30 is a schematic diagram illustrating a configuration in which a rotary body contacts a first connector constituted by an electrode and a second connector constituted by a second connector according to another conventional image forming apparatus.

Next, a connector according to a seventh embodiment is described below with reference to FIGS. 28A and 28B. FIG. 28A is a pattern diagram illustrating around the shaft 6*a* of the charging roller 6 and an electrode 660 along a line E-E' in FIG. 28B. FIG. 28B is a pattern diagram illustrating a contact state in which the shaft end 6*b* of the charging roller 6 contacts the electrode 660 according to the seventh embodiment. As illustrated in FIG. 28A, a small penetration hole 661 whose diameter is smaller than that of the shaft 6*a* of the charging roller 6 is formed in the electrode 660. With this configuration, the shaft end 6*b* of the charging roller 6 contacts a rim 661*a* of the penetration hole 661. In other words, the spherical shaft end 6*b* contacts the electrode 660 along line in a direction in which the charging roller 6 is rotated.

When the foreign substance is caught in a linear contact portion between the rim 661*a* of the penetration hole 661 and the shaft end 6*b* of the charging roller 6, the periphery of the shaft end 6*b* separated from the rim 661*a* of the penetration hole 661. However, since the electrode 660 is rotatably held by the coil spring 180 as illustrated in FIG. 8, the posture of the electrode 660 can be changed around the X axis, the Y axis, and the Z axis, and the electrode 660 is pressed to the charging roller 6 side by the coil spring 180. Therefore, even when the foreign substance is caught in the linear contact portion, since the coil spring 180 is shaken (rotated) to adjust the posture of the electrode 660 so as to maintain contact between the electrode 660 and the shaft end 6*b*, the shaft end 6*b* can continue to contact the electrode 660 in a new contact portion whose phase is 180 degrees differ from the portion in which the foreign substance is caught. Thus, even when the foreign substance is caught in a part of the linear contact portion between the electrode 660 and the shaft end 6*b*, electrically-conductive state can be kept.

Numerous additional modifications and variations are possible in light of the above teachings. It is therefore to be understood that, within the scope of the appended claims, the disclosure of this patent specification may be practiced otherwise than as specifically described herein.

What is claimed is:

1. A connector to electrically connect a rotary body having a shaft, the connector comprising:

a connecting terminal, electrically connected to either a power supply or ground, to contact the shaft of the rotary body either at least two points or along a line; and a posture adjuster to hold the connecting terminal to adjust the posture of one of the connecting terminal and the rotary body to maintain contact between the connecting terminal and the shaft of the rotary body, wherein the connecting terminal comprises a substantially V-shaped groove in one face thereof and formed along the shaft of the rotary body, and one end face of the shaft of the rotary body contacts two internal sloped faces of the V-shaped groove, a first sloped face and a second sloped face and wherein a deepest point of the V-shaped groove extends in a gravity direction, the gravity direction being different from a shaft direction of the rotary body.

2. The connector according to claim 1, wherein the shaft of the rotary body and the connecting terminal are pressed against each other by the posture adjuster.

3. The connector according to claim 2, wherein the posture adjuster comprises a coil spring to hold the connecting terminal therein.

4. The connector according to claim 1, wherein the connecting terminal comprises an abrasive portion on a face of the connecting terminal that contacts the shaft of the rotary body to grind the shaft of the rotary body.

5. The connector according to claim 1, wherein the shaft of the rotary body is movable in a direction orthogonal to the shaft of the rotary body, the V-shaped groove is opened so that the two points of the end face of the shaft of the rotary body slides along the two internal sloped faces of the V-shaped groove as the shaft of the rotary body is moved.

6. The connector according to claim 5, wherein the end face of the shaft of the rotary body has a semi-spherical shape, and the V-shaped groove has a groove angle that widens or narrows in the direction in which the shaft of the rotary body is movable.

7. The connector according to claim 1, wherein the end face of the shaft of the rotary body has a semi-spherical shape, and a first bevel angle between the first sloped face and a shaft centerline of the rotary body is set different from a second bevel angle between the second sloped face between the shaft center line of the rotary body.

8. A charging device comprising:

a charging roller having a shaft;

a power supply operatively connected to the charging roller to apply a predetermined voltage to the charging roller; and a connector, electrically connect the power supply with the charging roller, to supply the predetermined voltage to the charging roller, the connector comprising:

a connecting terminal to contact one end of the shaft of the charging roller either at least two points or along a line; and a posture adjuster to holds the connecting terminal to adjust the posture of one of the connecting terminal and the charging roller to maintain contact between the connecting terminal and the shaft of the charging roller, wherein the connecting terminal comprises a substantially V-shaped groove in one face thereof and formed along the shaft of the rotary body, and one end face of the shaft of the rotary body contacts two internal sloped faces of the V-shaped groove, a first sloped face and a second sloped face and wherein a deepest point of the V-shaped groove extends in a gravity direction, the gravity direction being different from a shaft direction of the rotary body.

9. The charging device according to claim 8, further comprising a second connector that contacts the other end of the shaft of the charging roller.

10. An image forming apparatus comprising:

an image carrier to carry a latent image;

a power supply to generate a voltage;

a rotary body, to which the voltage is applied, having a shaft; and a connector, electrically connect the power supply with the rotary body, to supply the voltage to the rotary body, the connector comprising:

a connecting terminal to contact the shaft of the rotary body either at least two points or along a line; and a posture adjuster that holds the connecting terminal to adjust the posture of one of the connecting terminal and the rotary body to maintain contact between the connecting terminal and the shaft of the rotary body, wherein the connecting terminal comprises a substantially V-shaped groove in one face thereof and formed along the shaft of the rotary body, and one end face of the shaft of the rotary body contacts two internal sloped faces of the V-shaped groove, a first sloped face and a second sloped face and wherein a deepest point of the V-shaped groove extends in a gravity direction, the gravity direction being different from a shaft direction of the rotary body.

11. The image forming apparatus according to claim 10, further comprising a second connector to contact the other end of the rotary body.

12. The image forming apparatus according to claim 10, wherein the end face of the shaft of the rotary body that contacts the connecting terminal has a semi-spherical shape.

13. The image forming apparatus according to claim 10, further comprising:

a process cartridge, removably installable in the image forming apparatus, wherein the rotary body comprises a charging roller, and the process cartridge houses the latent image carrier, the charging roller, and the connector.

* * * * *